US009007158B2

(12) United States Patent
Yoshikawa et al.

(10) Patent No.: US 9,007,158 B2
(45) Date of Patent: Apr. 14, 2015

(54) REACTOR

(71) Applicant: Sumitomo Electric Industries, Ltd., Osaka-shi (JP)

(72) Inventors: Kouhei Yoshikawa, Osaka (JP); Shinichiro Yamamoto, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 14/152,707

(22) Filed: Jan. 10, 2014

(65) Prior Publication Data

US 2014/0125308 A1 May 8, 2014

Related U.S. Application Data

(63) Continuation of application No. 13/789,060, filed on Mar. 7, 2013, now Pat. No. 8,659,381, which is a continuation-in-part of application No. 13/393,501, filed as application No. PCT/JP2010/062844 on Jul. 29, 2010, now Pat. No. 8,416,046.

(30) Foreign Application Priority Data

| | | |
|---|---|---|
| Aug. 31, 2009 | (JP) | 2009-199648 |
| Feb. 24, 2010 | (JP) | 2010-039278 |
| Jul. 9, 2010 | (JP) | 2010-156872 |

(51) Int. Cl.
*H01F 27/30* (2006.01)
*H01F 27/02* (2006.01)
(Continued)

(52) U.S. Cl.
CPC ..... *H01F 27/30* (2013.01); *H01F 27/022* (2013.01); *H01F 27/263* (2013.01); *H01F 27/306* (2013.01); *H01F 37/00* (2013.01)

(58) Field of Classification Search
USPC ..... 336/65, 83, 200, 232, 233–234, 90, 96
See application file for complete search history.

(56) References Cited

U.S. PATENT DOCUMENTS

| | | | |
|---|---|---|---|
| 2,992,405 | A | 7/1961 | Ursch |
| 3,244,960 | A | 4/1966 | Stevens et al. |

(Continued)

FOREIGN PATENT DOCUMENTS

| | | | |
|---|---|---|---|
| JP | S50-121958 | U | 10/1975 |
| JP | 61-055327 | U | 4/1986 |

(Continued)

OTHER PUBLICATIONS

Office Action in U.S. Appl. No. 13/387,960 dated Jan. 14, 2013.

(Continued)

*Primary Examiner* — Tuyen Nguyen
(74) *Attorney, Agent, or Firm* — Venable LLP; Michael A. Sartori; Tamatane J. Aga

(57) ABSTRACT

To provide a reactor with which resin can fully be packed between a core and a coil with ease, and in which the core can easily be handled when the reactor is manufactured.
The reactor includes: a coil 10 formed with paired coil elements 10A and 10B that are made of a spirally wound wire, the coil elements being coupled to each other in a paralleled state; internal core portions 22 that are fitted into the coil elements 10A and 10B to structure a part of an annular core 20; and exposed core portions 24 that are exposed outside the coil elements 10A and 10B to couple the internal core portions 22 to each other, to thereby form the rest of the annular core 20. The reactor includes an external resin portion that covers at least a part of an assembled product 1A made up of the coil 10 and the core 20. An interval between the inner end face 24*f* of the exposed core portion 24 and the end face of the coil 10 is 0.5 mm to 4.0 mm, whereby the resin can easily be packed between the coil 10 and the core 20.

5 Claims, 11 Drawing Sheets

(51) Int. Cl.

| | |
|---|---|
| ***H01F 27/26*** | (2006.01) |
| ***H01F 37/00*** | (2006.01) |

(56) References Cited

U.S. PATENT DOCUMENTS

| | | | |
|---|---|---|---|
| 3,587,168 | A | 6/1971 | Kolator |
| 3,711,807 | A | 1/1973 | Yamashita et al. |
| 3,774,298 | A | 11/1973 | Eley |
| 4,137,515 | A | 1/1979 | Akao et al. |
| 4,239,077 | A | 12/1980 | Dixon et al. |
| 4,586,016 | A | 4/1986 | Rilly et al. |
| 5,926,946 | A | 7/1999 | Minato et al. |
| 6,750,749 | B2 | 6/2004 | Shirahata et al. |
| 6,950,004 | B2 | 9/2005 | Godoy et al. |
| 8,279,035 | B2 | 10/2012 | Yoshikawa et al. |
| 2002/0057180 | A1 | 5/2002 | Shirahata et al. |
| 2003/0020588 | A1 | 1/2003 | Jin et al. |
| 2004/0257190 | A1 | 12/2004 | Peck et al. |
| 2009/0108971 | A1 | 4/2009 | Okamoto |
| 2010/0026434 | A1 | 2/2010 | Okamoto et al. |
| 2011/0025444 | A1 | 2/2011 | Sugiyama et al. |
| 2012/0092120 | A1 | 4/2012 | Yoshikawa et al. |
| 2012/0126928 | A1 | 5/2012 | Yoshikawa et al. |
| 2012/0206232 | A1 | 8/2012 | Yamamoto et al. |

FOREIGN PATENT DOCUMENTS

| | | | | |
|---|---|---|---|---|
| JP | 11-288824 | A | | 10/1999 |
| JP | 2000-340428 | A | | 12/2000 |
| JP | 2003-007547 | A | | 1/2003 |
| JP | 2003-197444 | A | | 7/2003 |
| JP | 2004-095570 | A | | 3/2004 |
| JP | 2004-327569 | A | | 11/2004 |
| JP | 2005-019764 | A | | 1/2005 |
| JP | 2007-027185 | A | | 2/2007 |
| JP | 2007134374 | A | * | 5/2007 |
| JP | 2007-180224 | A | | 7/2007 |
| JP | 2008-028290 | A | | 2/2008 |
| JP | 2008-041877 | A | | 2/2008 |
| JP | 2008-042051 | A | | 2/2008 |
| JP | 2008041879 | A | | 2/2008 |
| JP | 2008-159832 | A | | 7/2008 |
| JP | 2008-311284 | A | | 12/2008 |
| JP | 2009-026995 | A | | 2/2009 |
| JP | 2009-246219 | A | | 10/2009 |
| JP | 2009-246221 | A | | 10/2009 |
| JP | 2009-246222 | A | | 10/2009 |
| JP | 5299841 | B2 | | 9/2013 |
| WO | WO-2010/021113 | A1 | | 2/2010 |
| WO | WO-2010/110007 | A1 | | 9/2010 |

OTHER PUBLICATIONS

Office Action in Chinese Patent Application No. 201080034098.2, dated Mar. 14, 2013.
Office Action in U.S. Appl. No. 13/387,960, dated May 1, 2013.
Office Action in U.S. Appl. No. 13/387,960 dated Jul. 18, 2013.
Office Action in Japanese Patent Application No. 2010-097356, dated Sep. 5, 2013.
Office Action in U.S. Appl. No. 13/387,960, dated Sep. 18, 2013.
Notification of Reasons for Refusal in Japanese Patent Application No. 2013-129856, dated Aug. 5, 2014.

* cited by examiner

REACTOR

CROSS-REFERENCE TO RELATED APPLICATIONS

This application is a continuation of U.S. application Ser. No. 13/789,060, filed Mar. 7, 2013. U.S. application Ser. No. 13/789,060 is a continuation-in-part of U.S. application Ser. No. 13/393,501 which is the US National Stage of International Application No. PCT/JP2010/062844, filed Jul. 29, 2010 and claims the benefit thereof. The International Application claims priority to Japanese application No. 2009-199648 filed Aug. 31, 2009, No. 2010-039278 filed Feb. 24, 2010, and No. 2010-156872 filed Jul. 9, 2010, the entireties of which are incorporated herein by reference.

TECHNICAL FIELD

The present invention relates to a reactor. Particularly, the present invention relates to a reactor that includes an external resin portion covering the exterior of an assembled product made up of a core and a coil, and that makes it easier to pack resin structuring the external resin portion between the core and the coil when the external resin portion is molded.

BACKGROUND ART

A reactor that is installed in vehicles such as electric vehicles, hybrid vehicles and the like includes a core and a coil wound around the core. Representatively, the coil is structured with a pair of coil elements coupled to each other in a paralleled state. The core is structured in an annular shape to be fitted into the coil elements.

Patent Literature 1 discloses a reactor in which the portions of a core around which a coil is not wound (i.e., exposed core portions) are projected in top-bottom and right-left directions than the portions of the core around which the coil is wound (i.e., internal core portions). Employing this structure, the assembled product made up of the core and the coil is formed to have a substantially rectangular block shape, whereby a miniaturization of the reactor is achieved.

On the other hand, Patent Literature 2 discloses a reactor in which an assembled product made up of a core and a coil is covered by resin, whereby mechanical protection of the assembled product is achieved.

CITATION LIST

Patent Literature

Patent Literature 1: Japanese Unexamined Patent Publication No. 2004-327569 (FIG. 1)

Patent Literature 2: Japanese Unexamined Patent Publication No. 2007-180224 (FIG. 7)

SUMMARY OF INVENTION

Technical Problem

However, the reactor of the mode in which the assembled product made up of the core and the coil has its outer circumference covered by resin suffers from a problem that it is difficult for the resin to fully be packed between the core and the coil.

In order to achieve miniaturization of the reactor, it is desired to reduce the clearance between the core and the coil. However, when the clearance is small, it is difficult to fully pack the resin through between the core and the coil. Further, normally, the coil is disposed at the outer circumference of the core in the compressed state in its axial direction, and the adjacent ones of the turns of the coil are so close to each other that they are almost brought into contact with each other. Therefore, in the mode disclosed in Patent Literature 2 in which the exterior of the assembled product is covered with the resin, it is difficult for the resin to fully be packed through the aforementioned clearance or the clearance between the turns. In particular, relatively narrowing also the interval between the coil elements adjacent to each other for the purpose of miniaturization is associated with difficulty in packing the resin.

On the other hand, considering a case in which the resin is packed at the exterior of the assembled product disclosed in Patent Literature 1, difficulty in packing the resin becomes further significant. In the core of Patent Literature 1, each end face of the coil faces each exposed core portion, whereby the clearance between the end face of the coil and the exposed core portion is extremely narrow. Accordingly, it is difficult for the resin to be packed between the coil and the core through the clearance. This may result in formation of voids in the resin between the core and the coil, and the resin may fail to fully protect the assembled product mechanically or electrically.

The present invention has been made in consideration of the foregoing, and an object thereof is to provide a reactor that allows resin to be easily packed between a core and a coil.

Solution to Problem

The reactor of the present invention relates to a reactor that includes:

- a coil formed with paired coil elements that are made of a spirally wound wire, the coil elements being coupled to each other in a paralleled state;
- internal core portions that are fitted into the paired coil elements to structure a part of an annular core; and
- exposed core portions that are exposed outside the coil elements to couple the internal core portions to each other, to thereby form the rest of the annular core. The reactor includes an external resin portion that covers at least a part of an assembled product made up of the coil and the core. The reactor is characterized in that, in the exposed core portions, a cut-out corner portion is provided to at least a part of a joining portion of an inner end face facing an end face of the coil and an adjacent face that is continuous to the inner end face.

The cut-out corner portion representatively refers to a portion where at least a part of the ridge line formed by the inner end face and the adjacent face is cut out by a curved surface or a flat surface, and is structured with one of the curved surface and the flat surface. In the joining portion of the inner end face and the adjacent face where the cut-out corner portion is provided, since the curved surface or the flat surface structuring the cut-out corner portion is present as described above, the actual ridge line formed by the inner end face and the adjacent face is not present. Accordingly, the joining portion of the inner end face and the adjacent face may include a mode in which the joining portion is structured by the cut-out corner portion, and a mode in which the joining portion is structured with the cut-out corner portion and the ridge line formed by the inner end face and the adjacent face.

With this structure, provision of the cut-out corner portion, in each of the exposed core portions, to at least a part of the joining portion of the inner end face facing the end face of the coil and the adjacent face that is continuous to that inner end face makes it possible to guide the resin structuring the external resin portion between the core and the coil through the cut-out corner portion even in the case where the clearance between the end face of the coil and the inner end face of the exposed core portion is narrow, or in the case where the interval between the coil elements is narrow. Accordingly, with the structure described above, it becomes possible to improve the packing performance of the structuring resin, and to suppress the occurrence of voids between the core and the coil as much as possible. Further, the cut-out corner portion can also suppress occurrence of damage to the exposed core portions or damage to other members that are to be combined with the exposed core portions when the reactor is assembled or the like. When the exposed core portions are carried, there may be a case where the exposed core portions are handled by a manipulator or the like, or the exposed core portions are brought into contact with other members. Here, provision of the cut-out corner portion at each exposed core portion can suppress the corner portion from being chipped off. Further, since the joining portion of the inner end face and the adjacent face is not edge-like because of the presence of the cut-out corner portion, even when the exposed core portions are brought into contact with the coil, it is easier to prevent the insulating coating of the coil from being damaged.

In one mode of the reactor of the present invention, the cut-out corner portion may be structured by rounding a ridge line formed by the inner end face and the adjacent face.

With this structure, by rounding the ridge line formed by the inner end face and the adjacent face, it becomes possible to form the cut-out corner portion having the shape that extends along the virtual ridge line formed by the inner end face and the adjacent face and that facilitates the flow of the resin structuring the external resin portion. Therefore, the structuring resin can easily be introduced from the cut-out corner portion to the space between the core and the coil. Further, when the cut-out corner portion is structured by rounding the ridge line formed by the inner end face and the adjacent face, since the cut-out corner portion is structured with the curved surface, it becomes further easier to suppress the occurrence of damage to the exposed core portions when the reactor described above is assembled.

In one mode of the reactor of the present invention, at least one of an installed face of the reactor and an opposite face to the installed face in each of the exposed core portions may project further than an installed face of the reactor and an opposite face to the installed face in each of the internal core portions.

With this structure, by causing a particular face of each exposed core portion (the installed face and the face opposite thereto. representatively, the top and bottom faces) to project in the direction perpendicular to the particular face further than the internal core portions (such a core is referred to as a 3D core), it becomes possible to reduce the length in the coil axial direction of the exposed core portion (i.e., the thickness in the exposed core portion), and to reduce the projected area of the reactor as seen two-dimensionally. Further, this projection of the particular face of each exposed core portion widens the area in the inner end face that faces the end face of the coil, and causes the clearance between the core and the coil on the coil end face side to be sealed. As a result, it becomes further difficult to allow the structuring resin to be packed between the core and the coil. Further, in connection with the 3D core, it is particularly effective to provide the cut-out corner portion to the joining portion of the inner end face and the adjacent face, in terms of packing the structuring resin smoothly.

In one mode of the reactor of the present invention, the adjacent face of each of the exposed core portions may be a side face adjacent to the inner end face.

With this structure, it becomes easier to allow the structuring resin to be packed from between the side face of the exposed core portion and the coil end face. Particularly, in the case where each exposed core portion is structured with a pressurized powder compact, the direction along the ridge line formed by the inner end face and the side face can be aligned with the direction in which the exposed core portion is taken out from the molding assembly. With the structure in which the cut-out corner portion is provided along the ridge line, the joining portion formed between the inner end face and the adjacent face does not become an acute angle, and the exposed core portion can easily be taken out from the molding assembly.

In one mode of the reactor of the present invention, the adjacent face of each of the exposed core portions may be at least one of the installed face of the reactor adjacent to the inner end face and the opposite face to the installed face, and the cut-out corner portion may be formed to face a portion in the end face of the coil where the wires of the coil elements are paralleled to be next to each other.

With such a structure, it becomes easier to pack the structuring resin from between the installed face of the exposed core portion or the opposite face to the installed face and the coil end face. Particularly, even with the core in which the particular face of each of the exposed core portions (the installed face and the face opposite thereto. representatively, the top and bottom faces) is flush with the particular face of each of the internal core portions (this core is referred to as a flat core), since the cut-out corner portion is formed to face a portion in the end face of the coil where the wires of the coil elements are paralleled to be next to each other, the structuring resin can easily be packed between the coil elements.

One variation of the flat core may be, for example, a mode in which the length of each exposed core portion is increased in the direction that is in parallel to the installed face of the exposed core portion and that is perpendicular to the coil axial direction. In this case, similarly to the 3D core described above, since the area in the inner end face of the exposed core portion facing the end face of the coil widens, the clearance between the inner end face and the end face of the coil can be closed. Particularly, in the case where each exposed core portion is formed such that the outer circumference face of the coil and the adjacent face (side face) of the exposed core portion are flush with each other, the clearance is substantially closed. In contrast, as described above, provision of the cut-out corner portion to the joining portion of the inner end face and the adjacent face can facilitate the flow of the resin structuring the external resin portion between the core and the coil. However, as will be described later, the cut-out corner portion is preferably provided such that a change in the flow of the magnetic flux attributed to the cut-out corner portion becomes negligible.

As described above, in the case where the cut-out corner portion is provided to the joining portion of the inner end face of the exposed core portion and the adjacent face (i.e., the side face, the installed face and the face opposite to the installed face), the greater the cut-out corner portion, the easier the introduction of the structuring resin from between the exposed core portion and the coil. However, when the cut-out corner portion is excessively great, the area of the magnetic path in the core formed when the coil is excited is reduced, and the leakage flux may occur between each exposed core portion and the internal core portions. Accordingly, the size of the cut-out corner portion is set as appropriate such that the magnetic path area can fully be secured, and the loss incurred by the leakage flux falls within an acceptable range. That is, the cut-out corner portion is preferably provided such that a change in the flow of the magnetic flux attributed to the cut-out corner portion becomes negligible. In this manner, even in the case where miniaturization is achieved by narrowing the clearance between each end face of the coil and each exposed core portion and the interval between the coil elements, it becomes possible to fully secure the magnetic path area and to facilitate introduction of the structuring resin.

In one mode of the reactor of the present invention, the core may be a pressurized powder compact.

With this structure, even the core having a complicated shape such as the core including the cut-out corner portion or the 3D core described above can easily be structured, thanks to its being a pressurized powder compact.

In one mode of the reactor of the present invention, an interval between the inner end face of the exposed core portion and the end face of the coil may be 0.5 mm to 4.0 mm.

With this structure, while securing packing of the resin structuring the external resin portion between the inner end face of the exposed core portion and the end face of the coil, an increase in the size of the reactor (core) itself can be suppressed.

One mode of the reactor of the present invention may further include an internal resin portion that retains the shape of the coil. In this case, the external resin portion covers at least a part of the assembled product made up of the core and the coil provided with the internal resin portion.

With this structure, since the internal resin portion retains the shape of the coil, the coil can be handled as a member that does not expand or contract. Therefore, the manufacturability of the reactor can be improved. Further, since the coil and the core have a portion doubly covered by the internal resin portion and the external resin portion, mechanical and electrical protection can fully be achieved. Further, formation of the cut-out corner portion allows the resin structuring the external resin portion to surely be packed between the inner end face of the exposed core portion and the surface of the internal resin portion on the coil end face side.

One mode of the reactor of the present invention may further include a case that accommodates the assembled product.

With this structure, since the assembled product is stored in the case, the assembled product itself can mechanically and electrically be protected. Further, by employing a mode in which the case is made of a material being excellent in heat conductivity or has a great surface area (e.g., a mode that is provided with fins), the heat dissipating performance of the assembled product can be improved through the case. Further, the cut-out corner portion makes it easier to form the flow channel of the resin between the case and the assembled product when the resin structuring the external resin portion is packed between the assembled product and the case.

The reactor according to the invention can be preferably used for a component of a converter. A converter according to an aspect of the invention includes a switching element, a driving circuit that controls an operation of the switching element, and a reactor that makes a switching operation smooth, the converter converting an input voltage by the operation of the switching element. The reactor is the reactor according to the invention.

The converter according to the invention can be preferably used for a component of a power conversion device. A power conversion device according to an aspect of the invention includes a converter that converts an input voltage, and an inverter that performs conversion between direct current and alternating current, the power conversion device driving a load with power converted by the inverter. The converter is the converter according to the invention.

Advantageous Effects of Invention

With the reactor of the present invention, the resin structuring the external resin portion can fully be packed between the core and the coil, and the reactor in which the assembled product made up of the core and the coil is surely covered by the external resin portion can be obtained. Further, occurrence of damage to the core when the reactor is assembled can also be suppressed.

BRIEF DESCRIPTION OF DRAWINGS

FIG. 5 (I) is an example of the reactor according to Embodiment 1 of the present invention; and FIG. 5 (II) is an example of a reactor that includes a core having no cut-out corner portion.

FIG. 6 is a perspective view showing other forms of the exposed core portion according to Embodiment 1, in which: FIG. 6 (I) shows an example that includes cut-out corner portions over the entire virtual circumference of the inner end face; FIG. 6 (II) shows an example that includes the cut-out corner portions at the joining portions of the side faces and the inner end face, at facing portions in the inner end face where the coil elements are disposed in parallel, and at the joining portions of the installed face and the inner end face; FIG. 6 (III) shows an example that includes the cut-out corner portions at the joining portions of the side faces and the inner end face, and at a part of the joining portion of the installed face and the inner end face; FIG. 6 (IV) shows an example that includes the cut-out corner portions at only the part on the side face of the joining portion of the installed face and the inner end face; FIG. 6 (V) shows an example that includes the cut-out corner portion only at the central portion at the joining portion of the installed face and the inner end face; FIG. 6 (VI) shows an example that includes the cut-out corner portion at the joining portion of the installed face and the inner end face; and FIG. 6 (VII) shows an example that includes the cut-out corner portions only at a part of the joining portion of the side face and the inner end face.

FIG. 8 shows a core used for a reactor according to Embodiment 2 of the present invention, in which: FIG. 8 (I) is a partial perspective view of the core having the cut-out corner portions each of whose cross section is rectangular; FIG. 8 (II) is a partial perspective view of the core having the cut-out corner portions each of whose cross section is triangular; FIG. 8 (III) is a plan view of the exposed core portion shown in FIGS. 8 (I) and 8 (II).

DESCRIPTION OF EMBODIMENTS

Figure 1:
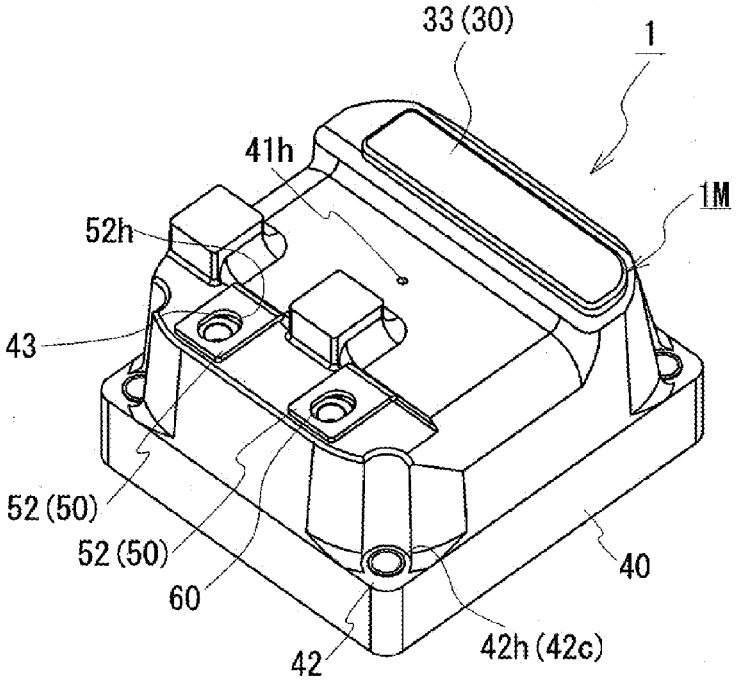
FIG. 1 is a perspective view showing a reactor according to Embodiment 1 of the present invention.

In the following, a description will be given of embodiments of the present invention.

(Embodiment 1)

With reference to FIGS. 1 to 5, a description will be given of a reactor according to Embodiment 1 of the present invention. In the drawings, identical members are denoted by identical reference signs.

[Overall Structure]

The reactor 1 is structured in the following manner: a coil molded product 1M (FIG. 3) in which a coil 10 (FIG. 3) and a part of an annular core 20 (FIG. 3) are integrally molded with an internal resin portion 30 (FIG. 3); and an assembled product 1A (FIG. 3) being an assembled product of the coil molded product 1M and the rest of the core 20 are covered by an external resin portion 40 (FIG. 1). The core 20 includes internal core portions 22 (FIGS. 3 and 4) fitted inside the coil 10, and exposed core portions 24 (FIGS. 2 to 4) that join respective end faces of the internal core portions 22, and that are exposed outside the coil 10. Further, by the external resin portion 40, terminal fittings 50 (FIG. 1) are integrally molded, and at the same time, nut accommodating holes 43 (FIG. 1) are also formed. Using nuts 60 (FIG. 1) fitted into the nut accommodating holes 43 and the terminal fittings 50, a terminal block is structured.

[Installation State, Use]

The reactor 1 can be applied where the conduction condition is, e.g., the maximum current (DC) being about 100 A to 1000 A; the average voltage being about 100 V to 1000 V; and the working frequency being 5 kHz to 100 kHz. Representatively, the reactor 1 can suitably be used for a component of a power converter apparatus to be installed in a vehicle, such as an electric vehicle, a hybrid vehicle or the like. When the reactor 1 is used as a component of a DC-DC converter of a hybrid vehicle, for example, the flat bottom face of the reactor 1 is directly installed on a not-shown cooling base (fixation target), as the installed face (the face where the bottom face of the internal resin portion 30 and the bottom faces of the exposed core portions 24 are exposed in FIG. 2).

Figure 4:
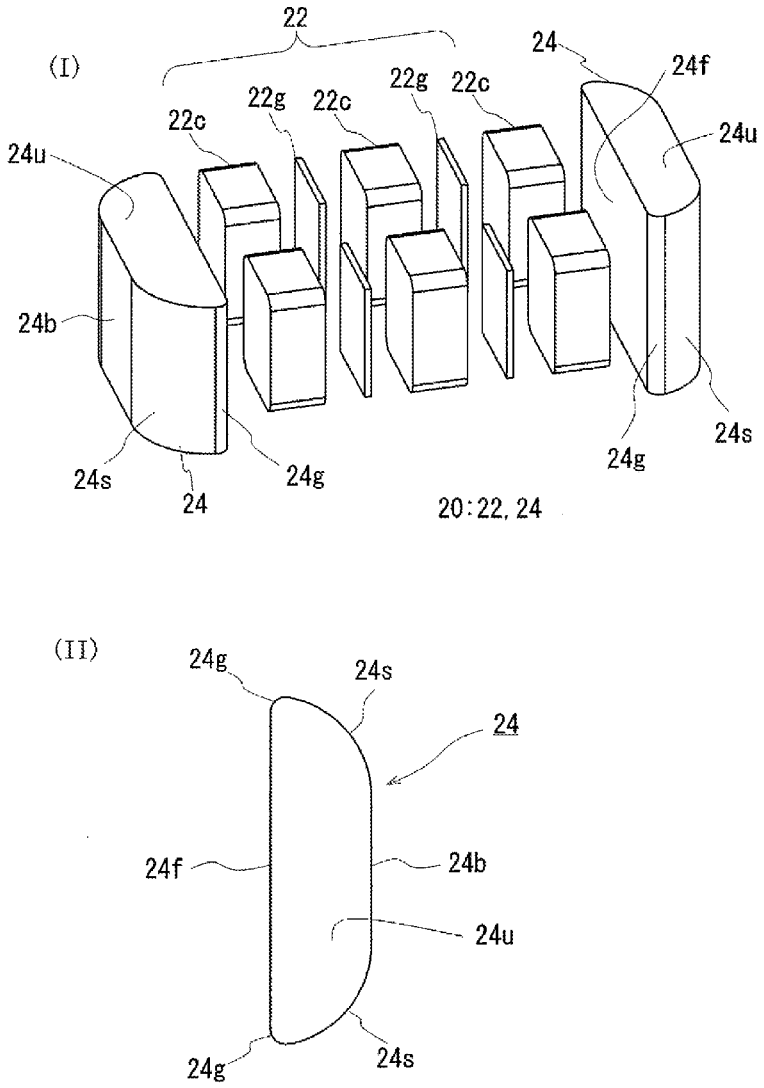
FIG. 4 (I) is an exploded perspective view of a core used for the reactor shown in FIG. 1, and FIG. 4 (II) is a plan view of an exposed core portion structuring the core.

The reactor 1 is most characterized in that, as shown in FIG. 4, in each of the exposed core portions 24, a ridge line formed by an inner end face 24*f* that faces respective end faces of the internal core portions 22 and the coil and a side face 24*s* adjacent to the inner end face 24*f* is rounded to thereby form a cut-out corner portion 24*g*. In the following, a description will be given of the reactor 1 and the constituents thereof, based on that the installed side when the reactor 1 is installed on the cooling base is the bottom side and the opposite side thereof is the top side.

[Coil Molded Product]

Figure 3:
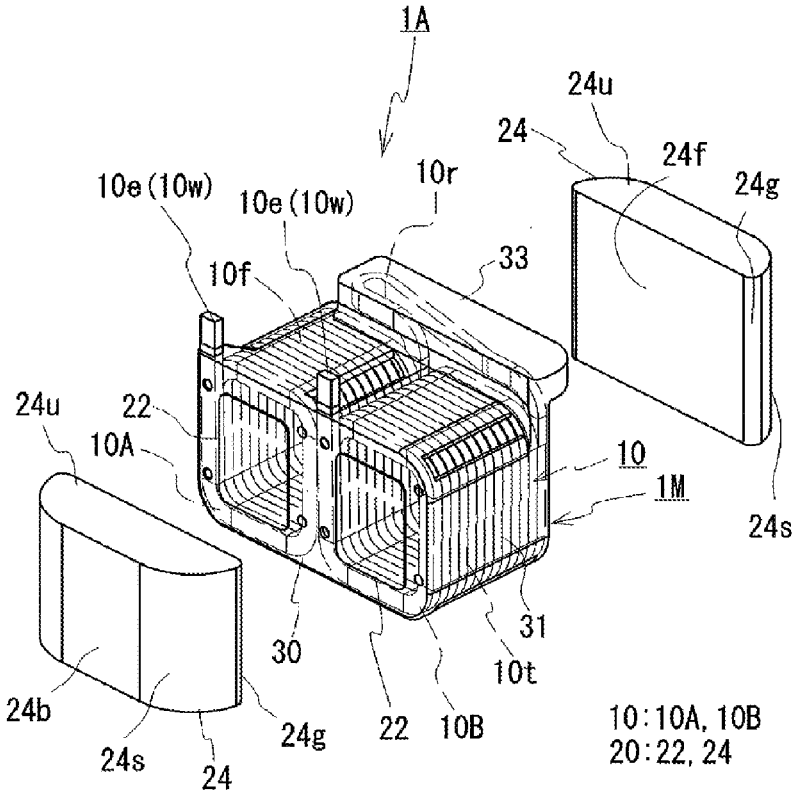
FIG. 3 is an exploded perspective view of an assembled product structuring the reactor shown in FIG. 1.

As shown in FIG. 3, the coil molded product 1M constituting the reactor 1 includes the coil 10, the internal resin portion 30 that covers most of the outer circumference of the coil 10, and the internal core portions 22 whose description will follow.

<<Coil>>

The coil 10 includes a pair of coil elements 10A and 10B formed by a spirally wound wire 10*w*. The coil elements 10A and 10B are identical to each other in the number of turns, each being a coil substantially rectangular (elongated rectangular, with rounded corners) as seen axially, and are paralleled to each other sideways such that their respective axial directions are in parallel to each other. Further, the coil elements 10A and 10B are structured with a single wire without a joined portion. Specifically, on one end side of the coil 10, one end 10*e* and the other end 10*e* of the wire 10*w* are led out upward. On the other end side of the coil 10, the coil elements 10A and 10B are coupled to each other via a couple portion 10*r*, which is the wire 10*w* being bent in a U-shape. This structure allows the coil elements 10A and 10B to be identical to each other in the winding direction. Further, in the present embodiment, the couple portion 10*r* projects outward and higher than a turn-formed face 10*f* at the top of the coil elements 10A and 10B. Then, the ends 10*e* of the coil elements 10A and 10B are led out upward above the turn portion 10*t* (here, the turn-formed face 10*f*), and are connected to the terminal fittings 50 (FIG. 1) for supplying power to the coil elements 10A and 10B.

What is used as the wire 10*w* structuring the coil elements 10A and 10B is a coated rectangular wire, which is a copper-made rectangular wire coated by enamel (representatively, polyamide-imide). The coated rectangular wire is wound edgewise, to form the hollow prism-like coil elements 10A and 10B. In addition, the wire is not limited to those whose conductor is a rectangular wire, and the cross section may be in various shape such as circular, polygonal and the like. The rectangular wire is easier than the round wire in forming a coil having a higher space factor.

<<Internal Resin Portion>>

At the outer circumference of the coil 10 having the structure described above, the internal resin portion 30 that retains the coil 10 in the compressed state is formed. The internal resin portion 30 includes a turn covering portion 31 that covers a turn portion 10*t* of the coil elements 10A and 10B so as to substantially conform to the outer shape of the coil elements 10A and 10B, and a couple portion covering portion 33 that covers the outer circumference of the couple portion 10*r*. The turn covering portion 31 and the couple portion covering portion 33 are integrally molded, and the turn covering portion 31 covers the coil 10 by a substantially uniform thickness. In the present embodiment, while the internal core portions 22 are integrated with the coil 10 by the internal resin portion 30, the thickness of the internal resin portion 30 between the internal core portions 22 and the coil 10 is also substantially uniform. It is to be noted that, the corners of the coil elements 10A and 10B and the ends 10*e* of the wire are exposed outside the internal resin portion 30. Further, the turn covering portion 31 chiefly functions to secure the insulation between the coil elements 10A and 10B and the internal core portions 22, and to position the internal core portions 22 with reference to the coil elements 10A and 10B. On the other hand, the couple portion covering portion 33 functions to mechanically protect the couple portion 10*r* in forming the external resin portion 40 (FIGS. 1 and 2) at the outer circumference of the reactor 1.

Further, between the coil elements 10A and 10B in the internal resin portion 30, a sensor-use hole 41*h* (FIG. 1) for storing a not-shown temperature sensor (e.g., a thermistor) is formed.

The resin that structures the internal resin portion 30 as described above is suitably a material that has enough heat-resistance so as not to be softened even when the maximum temperature of the coil and the magnetic core is reached when the reactor 1 including the coil molded product 1M is operated, and that can be applied to transfer molding, injection molding and the like. Particularly, a material that exhibits excellent insulating performance is preferable. Specifically, a thermosetting resin such as epoxy or the like, a thermoplastic resin such as polyphenylene sulfide (PPS) resin, liquid crystal polymer (LCP) or the like can suitably be used. Here, the epoxy resin is used. Further, mixing a filler made of at least one ceramics selected from silicon nitride, alumina, aluminum nitride, boron nitride, and silicon carbide with the aforementioned resin, the heat dissipating performance can be enhanced.

[Core]

The core 20 is an annular member that forms an annular magnetic path (closed magnetic path) when the coil 10 is excited. The core 20 includes a pair of internal core portions 22 respectively fitted inside the coil elements 10A and 10B, and a pair of exposed core portions 24 exposed outside the coil 10.

Of the core 20, the internal core portions 22 are each a member in a shape of substantially rectangular parallelepiped. As shown in FIG. 4, each of the internal core portions 22 is made up of core pieces 22*c* each made of a soft magnetic material such as iron, steel or the like, and gap members 22*g* each made of a material lower in magnetic permeability than the core pieces, i.e., representatively, a nonmagnetic material such as alumina. The core pieces 22*c* and the gap members 22*g* are alternately disposed and joined by an adhesive agent. The core pieces 22*c* may each be a laminated structure being a lamination of a plurality of electromagnetic steel sheets, or a pressurized powder compact of soft magnetic powder. Here, the pressurized powder compact is used. The gap members 22*g* are each a plate-shaped member disposed between the core pieces 22*c* for the purpose of adjusting inductance. The number of the core pieces 22*c* and the gap members 22*g* can be selected as appropriate so that the reactor 1 obtains a desired inductance. Further, the shapes of the core pieces 22*c* or the gap members 22*g* can be selected as appropriate. Then, the end faces of the internal core portions 22 slightly project from the end faces of the internal resin portion 30.

On the other hand, the exposed core portions 24 are each a block element structured with a material that is similar to the core pieces 22*c*. Here, what is used is the exposed core portion 24 that has a substantially trapeziform cross section, that is made of a pressurized powder compact of soft magnetic powder, and that includes: the inner end face 24*f* facing the end face of the coil molded product 1M; an outer end face 24*b* that is opposite to the inner end face 24*f* and appears on the outer side of the annular core; opposite side faces 24*s* that each connect the inner end face 24*f* and the outer end face 24*b*; a substantially trapeziform face (the bottom face 24*d* (FIG. 2)) that becomes the installed face when the reactor 1 (FIG. 1) is installed; and the opposite face (the top face 24*u*) that is opposite thereto.

Further, the cut-out corner portion 24*g* is provided at the joining portion of the inner end face 24*f* and each of the opposite side faces 24*s*. In the present embodiment, by rounding the ridge line formed by the inner end face 24*f* and each of the opposite side faces 24*s*, the cut-out corner portion 24*g* that has a uniform curvature along the top-bottom direction of the exposed core portions 24 is formed. Further, the inner end face 24*f* and each side face 24*s* are joined by a curved surface that structures the cut-out corner portion 24*g*. The cut-out corner portions 24*g* are preferably formed when the pressurized powder compact is molded using a molding assembly having the curved surface portions with which the ridge lines are formed as being rounded. Use of such a molding assembly allows the cut-out corner portions 24*g* to be formed by the curved portions of the molding assembly. Alternatively, a pressurized powder compact having not-rounded ridge lines may previously be formed, and the cut-out corner portions 24*g* may be processed in an ex-post manner by subjecting the ridge lines to cutting, grinding, abrasive operation or the like. For example, in the present embodiment, the cut-out corner portions 24*g* are provided over the entire region of the virtual ridge lines formed by the inner end face 24*f* and the side faces 24*s* of each exposed core portion 24. However, by employing the aforementioned works such as cutting as appropriate, it becomes possible to obtain a structure in which the cut-out corner portions are provided only to a part of the joining portion of the inner end face 24*f* and each side face 24*s* and a part of the ridge line formed by the inner end face 24*f* and each side face 24*s* is present. Further, the cross-sectional shape of the cut-out corner portion 24*g* is not limited to an arc-shape, and it may be in a chamfered shape so that the ridge line formed by the inner end face 24*f* and each side face 24*s* has a flat surface. In this case, the cut-out corner portion 24*g* is structured with a flat surface. Such a cut-out corner portion 24*g* is preferably provided such that the cross-sectional area of the exposed core portions does not become smaller than the cross-sectional area of the internal core portions, and a change in the flow of the magnetic flux attributed to the cut-out corner portion becomes negligible.

Figure 5:
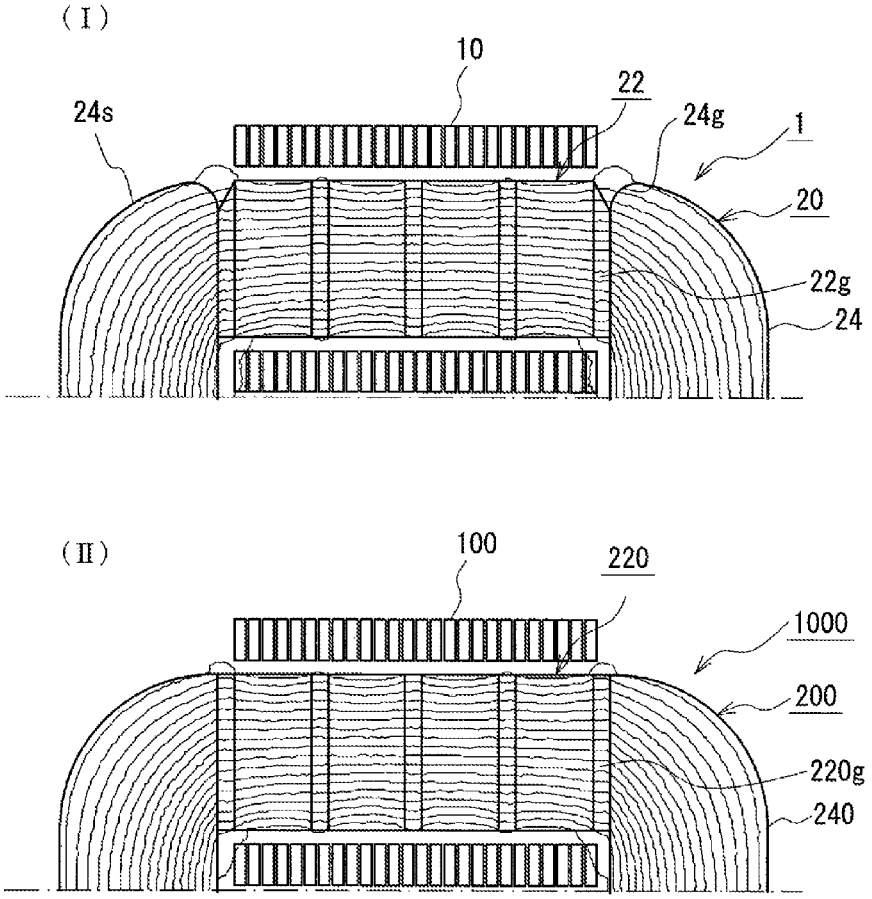
FIG. 5 is an explanatory illustration showing a flow of a magnetic flux when the coil of the reactor is excited.

The arc-radius of the cut-out corner portion 24*g* of the present embodiment is set to 3 mm. When the arc-radius is about 1 mm or more and 10 mm or less, an excessive reduction in the magnetic path area incurred by formation of the cut-out corner portion 24*g* can be prevented. FIG. 5 shows a result obtained by simulating the flow of the magnetic flux when the coil is excited, in which the fine lines represent the magnetic flux. Though the reactor shown in FIG. 5 only shows as to one of the coil elements and the surroundings, actually, the symmetric structure with reference to the dashed-dotted line is present. It is to be noted that, in FIG. 5, the internal resin portion is not shown. Further, the number of the core pieces and the gap members shown in FIG. 5 is merely an example.

A reactor 1000 shown in FIG. 5 (II) is structured similarly to the reactor 1 except for lack of the cut-out corner portions, and includes a coil 100 and a core 200 that includes internal core portions 220 and the exposed core portions 240. As shown in FIG. 5 (II), in the reactor 1000, though the magnetic flux slightly leaks from the portions between the internal core portions 220 where the coil 100 is disposed and the exposed core portions 240 where the coil 100 is not disposed (from the portion corresponding to each gap member 220*g*), the loss attributed to the leakage falls within an acceptable range. On the other hand, in the reactor 1 provided with the cut-out corner portions 24*g*, though slight leakage of the magnetic flux is also recognized from the portions between the internal core portions 22 where the coil 10 is disposed and the exposed core portions 24 where the coil 10 is not disposed (from the portion corresponding to each gap member 22*g*), it is recognized that the loss is as small as the reactor 1000. Thus, with the reactor 1, the cut-out corner portions 24*g* are provided such that the loss attributed to the leakage flux becomes substantially negligible. It is to be noted that, as the example shown in FIG. 5 (I), by providing also the gap members 22*g* with cut-out portions that are similar to the cut-out corner portions 24*g*, it becomes possible to obtain a mode in which the cut-out portions having the function (whose description will follow) similar to that of the cut-out corner portions 24*g* are also provided to the internal core portions 22, without substantially reducing the magnetic path area of the internal core portions 22.

As shown in FIG. 2, when the assembled product 1A (FIG. 3) is structured by combining the coil molded product 1M and the exposed core portions 24, each cut-out corner portion 24*g* (as well as the cut out portion of each gap member described above) forms a groove (FIG. 2) between the side face 24*s* of the exposed core portion 24 and the side face of the turn covering portion 31 in the coil molded product 1M. The groove functions as a guide groove for introducing the resin structuring the external resin portion 40 between the inner end face 24*f* of the exposed core portion 24 and the end face of the coil molded product 1M when the external resin portion 40 is molded over the exterior of the assembled product 1A. Further, when the assembled product 1A is structured, the cut-out corner portions 24*g* also function to suppress the periphery of each exposed core portion 24 from being chipped off even when the exposed core portion 24 is handled by a manipulator or the like. Then, the exposed core portions 24 are disposed so as to connect between the opposite ends of a pair of paralleled internal core portions 22, and joined to the internal core portions 22 by an adhesive agent. By joining the internal core portions 22 and the exposed core portions 24, the closed loop-like (annular) core 20 (FIG. 3) is formed. In a state where the internal core portions 22 (FIG. 3) and the exposed core portions 24 are joined to each other, the side faces of the exposed core portions 24 project outward than the outer side faces of the internal core portions 22. Therefore, by disposing the coil on the outer circumference of the internal core portions 22, substantially whole the circumference of the coil end faces face the inner end faces 24*f* of the exposed core portions, respectively.

Further, as shown in FIGS. 3 and 4, the exposed core portions 24 are different from each other in height (the dimension in the top-bottom direction in FIGS. 3 and 4). The top and bottom faces of the one of the exposed core portions 24 (the one on the right side in FIG. 3) that is disposed under the couple portion covering portion 33 project upward and downward than the top and bottom faces of the internal core portions 22, and are substantially flush with the top and bottom faces of the turn covering portion 31. In contrast thereto, the bottom face 24*d* (FIG. 2) of the other one of the exposed core portions 24 (the one on the left side in FIG. 3) that is disposed on the wire end 10*e* side projects downward than the bottom face of the internal core portions 22 to be substantially flush with the bottom face of the turn covering portion 31. The top faces 24*u* of the exposed core portions 24 are substantially flush with the top faces of the internal core portions 22, to be lower than the top face of the turn covering portion 31. On the other hand, the one exposed core portion 24 is smaller in thickness (i.e., the dimension in the coil axial direction) than the other exposed core portion 24. That is, though the exposed core portions 24 are different from each other in height and in thickness, they secure substantially equivalent volumes. This allows the exposed core portions 24 to have substantially equivalent magnetic characteristics. In addition, arrangement of the couple portion 10*r* of the coil 10 to be positioned higher than the turn-formed face 10*f* (FIG. 3) makes it possible to dispose the thinner one of the exposed core portions 24 than the other exposed core portion 24 under the couple portion covering portion 33. Thus, miniaturization of the projected area of the reactor can be achieved. The top and bottom faces of the exposed core portions 24 are preferably flush with at least the top and bottom faces of the internal core portions 22. This is because, for example, when the top faces 24*u* of the exposed core portions 24 are lower than the top faces of the internal core portions 22, the magnetic path may not fully be secured in the transition from the internal core portions 22 to the exposed core portions 24.

Figure 2:
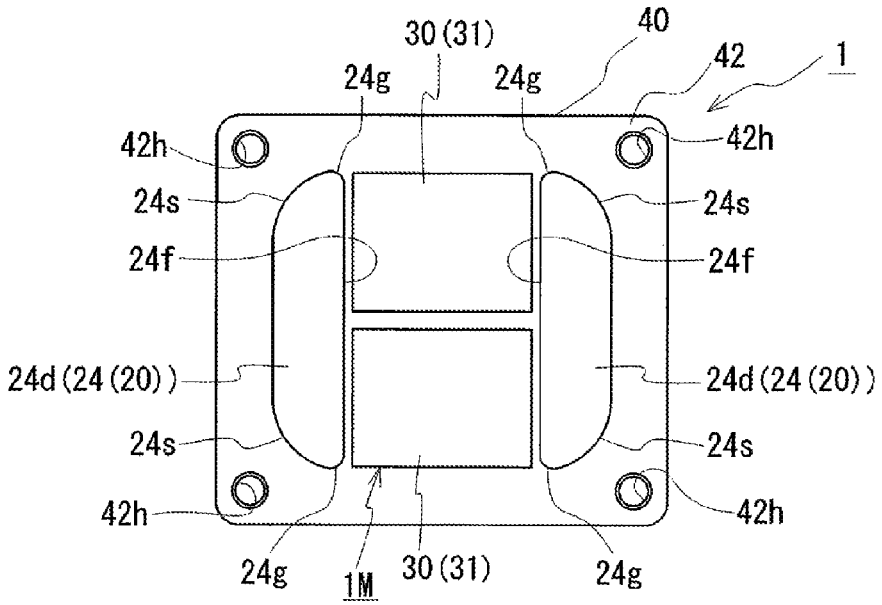
FIG. 2 is a bottom view of the reactor shown in FIG. 1.

Further, in the reactor 1, as shown in FIG. 2, the bottom faces 24*d* of the exposed core portions 24 of the core 20 in the annularly assembled state are structured to be substantially flush with the bottom face to be the installed face of the coil molded product 1M. With this structure, when the reactor 1 is fixed to the cooling base, not only the internal resin portion 30 but also the exposed core portions 24 are brought into contact with the cooling base. Therefore, the heat generated by the reactor 1 in operation can efficiently be dissipated.

Further, it is preferable to set the interval between the inner end face 24*f* of each exposed core portion 24 and each end face of the coil to be 0.5 mm to 4.0 mm. By setting the interval to 0.5 mm or more, it becomes easier for the resin structuring the external resin portion 40 to be packed between the inner end face 24*f* of the exposed core portion 24 and the end face of the coil 10 (FIG. 3). Further, by setting the interval to 4.0 mm or less, an increase in the size of the core 20 can be suppressed. It is to be noted that, in a case of the coil 10 provided with the internal resin portion 30, the interval between the inner end face 24*f* of the exposed core portion 24 and the end face of the coil 10 is the interval between the inner end face 24*f* of the exposed core portion 24 and the end face of the coil molded product 1M. In the present embodiment, the interval between the inner end face 24*f* of the exposed core portion 24 and the end face of the coil molded product 1M is set to 0.5 mm.

[Terminal Fittings and Nut]

To the ends 10*e* (FIG. 3) of the wire structuring the coil, the terminal fittings 50 (FIG. 1) are respectively connected. The terminal fittings 50 each include a connection face 52 for connecting to any external device such as a power supply, a weld face (not shown) to be welded to the end 10*e* of the wire, and a buried portion (not shown) that integrates the connection face 52 and the weld face to be covered by the external resin portion 40. The fittings 50 are mostly buried in the external resin portion 40, and only the connection faces 52 are exposed outside the external resin portion 40 whose description will follow. The connection faces 52 are both disposed on the other exposed core portion 24 whose height is lower than the other (FIG. 3), and the space between the top face 24*u* of the exposed core portion 24 (FIG. 3) and the connection faces 52 is packed with the external resin portion 40, to structure the terminal block. Since the terminal fittings 50 are disposed on the exposed core portion 24 whose height is low, it becomes possible to reduce the height of the reactor including the terminal fittings 50 as compared to the case where the terminal fittings are provided on the coil to thereby form the terminal block separately.

In the terminal block, a nut 60 is disposed under each of the connection faces 52 (FIG. 1). The nuts 60 are accommodated in nut accommodating holes 43 molded with the external resin portion 40, whose description will follow, in a locked state. The locking is realized by fitting the hexagonal nuts 60 into the hexagonal nut accommodating holes 43. Then, the connection faces 52 are disposed so as to cover the opening of the nut accommodating holes 43.

Each connection face 52 is provided with an insertion hole 52*h* whose inner diameter is smaller than the diagonal dimension of the nut 60. Thus, the connection faces 52 prevent the nuts 60 from coming off from the nut accommodating holes 43. When the reactor is to be used, terminals that are provided at the tip of not-shown lead wires are overlaid on the connection faces 52, and the terminals and the connection faces 52 are penetrated through by bolts (not shown), which bolts screw with the nuts 60. Thus, the coil 10 (FIG. 3) is supplied with power from the external device (not shown) connected to the base end of the lead wires. In the present embodiment, in a state where the terminals and the bolts are attached to the terminal block, the height of the connection faces 52 is set such that the top faces of the bolts become lower than the highest position in the reactor, that is, in the external resin portion 40 whose description will follow, the flat surface connecting between the couple portion covering portion 33 covering the couple portion of the coil and the protective portion covering the welded portion of the wire ends 10*e* (FIG. 3) and the terminal fittings 50. Therefore, the heads of the bolts do not locally project from the reactor 1.

[External Resin Portion]

As shown in FIG. 2, the external resin portion 40 is formed such that the bottom face of the coil molded product 1M and the bottom faces 24*d* of the exposed core portions 24 are exposed, and such that, as shown in FIG. 1, most of the top face and the entire outer side faces of the assembled product 1A (FIG. 3) made up of the coil molded product 1M and the exposed core portions 24 are covered. Exposure of the bottom face of the coil molded product 1M and the bottom faces 24*d* of the exposed core portions 24 outside the external resin portion 40 allows the heat generated by the reactor 1 to efficiently be dissipated into the cooling base. Further, the external resin portion 40 covering the top face and the outer side faces of the assembled product 1A in the manner described above achieves mechanical protection of the assembled product 1A.

More specifically, as shown in FIG. 2, the external resin portion 40 is formed such that the bottom faces 24*d* of the exposed core portions 24 and the bottom face of the coil molded product 1M (the turn covering portion 31) are exposed on the side of the installed face of the reactor 1, and that the top face of the couple portion covering portion 33 is exposed on the top side of the reactor 1 as shown in FIG. 1.

Further, the external resin portion 40 includes flange portions 42 that project outer than the contour of the assembled product 1A (FIG. 3) made up of the coil molded product 1M and the exposed core portions 24 (FIG. 3) when the reactor is seen two-dimensionally. At the flange portions 42, through holes 42*h* for bolts (not shown) for fixing the reactor 1 to the cooling base are formed. In the present embodiment, metal collars 42*c* are placed by insert molding of the external resin portion 40, the interior of each collar 42*c* being formed as the through holes 42*h*. The metal collars 42*c* may be made of brass, steel, stainless steel or the like. The through holes 42*h* may be formed by the resin structuring the external resin portion 40.

The external resin portion 40 further includes a protective portion at its top face that covers joining portions between the coil ends 10*e* (FIG. 3) and the terminal fittings 50. The protective portion is molded into a substantially rectangular block shape. Additionally, the external resin portion 40 has its top face molded so as to be flush with the tip of the sensor storing pipe projecting from the internal resin portion 30, whereby the sensor-use hole 41*h* is structured.

The external resin portion 40 has its side faces formed as sloped faces that widen from the top of the reactor 1 to the bottom thereof. Provision of such sloped faces facilitates removal of the molded reactor from the molding assembly in the case where the external resin portion 40 is molded by having the assembled product 1A (FIG. 3) made up of the coil molded product 1M and the exposed core portions 24 (FIG. 3) in the upside-down state, a description of which will follow.

As the resin structuring the external resin portion 40, unsaturated polyester can be employed. The unsaturated polyester is preferable because it does not crack easily and is inexpensive. In addition, for example, epoxy resin, urethane resin, PPS resin, polybutylene terephthalate (PBT) resin, acrylonitrile butadiene styrene (ABS) resin and the like can be employed as the external resin portion 40. The resin structuring the external resin portion 40 may be identical to or different from the resin structuring the internal resin portion 30. Further, it is also possible to cause the resin structuring the external resin portion 40 to contain the filler made of ceramics described above, to thereby enhance the heat dissipating performance.

<Manufacturing Method of Reactor>

The reactor 1 described in the foregoing is manufactured through the following (1) to (3) general steps.

(1) A first molding step of molding the internal resin portion over the coil and the internal core portions to obtain the coil molded product.

(2) An assembling step of assembling the coil molded product and the exposed core portions into the assembled product.

(3) A second molding step of molding the external resin portion over the assembled product to obtain the reactor.

(1) First Molding Step

First, one wire 10*w* is wound to form the coil 10 in which the pair of coil elements 10A and 10B are coupled by the couple portion 10*r* (FIG. 3). Next, the internal core portions 22 are prepared, and the internal core portions 22 are inserted inside the coil elements 10A and 10B. Subsequently, a molding assembly is prepared for molding the internal resin portion 30 over the outer circumference of the combined coil 10 and the internal core portions 22, and the coil 10 and the internal core portions 22 are stored in the molding assembly. Here, the portions corresponding to the corners of the coil elements 10A and 10B are supported by convex portions (not shown) at the inner face of the molding assembly, such that a certain gap is formed between the inner face of the molding assembly excluding the inner face corresponding to the convex portions and the coil 10. Further, the end faces of the internal core portions 22 are supported by the concave portions of the molding assembly, such that a certain gap is also formed between the internal core portions 22 and the coil elements 10A and 10B.

The molding assembly used in molding is structured with a pair of first mold and second mold. The first mold includes an end plate positioned on one end side (the leading end and terminating end side) of the coil 10. On the other hand, the second mold includes an end plate positioned on the other end side (the couple portion 10*r* side) of the coil and a sidewall covering the surrounding of the coil 10.

Further, the first and second molds are provided with a plurality of rod-shaped elements that can advance into and recede from the inside of the molding assembly by a drive mechanism. Here, a total of eight rod-shaped elements are used, to push the substantial corner portions of the coil elements 10A and 10B, to thereby compress the coil 10. It is to be noted that, because it is difficult for the couple portion 10*r* to be pushed by the rod-shaped elements, the portion below the couple portion 10*r* is pushed by the rod-shaped elements. In order to minimize the portions where the coil 10 is uncoated by the internal resin portion, the rod-shaped elements are formed to be as thin as possible, while enough strength and heat-resistance for compressing the coil 10 are secured. At the stage where the coil 10 is placed in the molding assembly, the coil 10 is still uncompressed, and there exists a clearance between each ones of adjacent turns.

Next, the rod-shaped elements are caused to advance into the molding assembly such that the coil 10 is compressed. This compression brings the adjacent turns of the coil 10 into contact with each other, thereby substantially eliminating the clearance between each ones of the turns. Further, the sensor storing pipe is disposed at a prescribed position in the coil 10 in the compressed state in the molding assembly.

Thereafter, epoxy resin is injected from a resin injection port into the molding assembly. When the injected resin has cured to a certain extent to be capable of retaining the coil 10 in the compressed state, the rod-shaped elements may be receded from the molding assembly.

When the resin has cured, and the coil molded product 1M that retains the coil 10 in the compressed state and the internal core portions 22 is molded, the molding assembly is opened and the molded product 1M is taken out from the molding assembly.

The obtained coil molded product 1M (FIG. 3) has its positions having been pushed by the rod-shaped elements uncoated by the internal resin portion, and hence the coil molded product 1M is molded into a shape with a plurality of small pores. The small pores may be packed with an appropriate insulating material or the like, or may be left as they are. It is to be noted that, in the case where the coil 10 is not compressed and left as being in the free length, the pressing by the rod-shaped elements as described above is not necessary. Further, instead of using the rod-shaped elements that compress the coil 10 in the molding assembly, it is possible to use an appropriate jig (not shown) that retains the coil 10 in the compressed state, and the coil molded product 1M may be molded by storing the coil 10 together with the jig in the molding assembly.

(2) Assembling Step

First, at each end of the wire of the produced coil molded product 1M, the terminal fitting 50 is welded. At this stage of welding, the connection face 52 of the terminal fitting is arranged substantially in parallel to the weld face, and extends in the top-bottom direction in FIG. 1. After the external resin portion 40 is molded, the connection face 52 is bent approximately by 90° so as to overhang the nut 60.

Next, the end faces of the internal core portions 22 are sandwiched by the exposed core portions 24. Thus, the internal core portions 22 and the exposed core portions 24 are joined to each other to form the annular core 20. The exposed core portions 24 and the internal core portions 22 are joined to each other using an adhesive agent.

(3) Second Molding Step

Next, a molding assembly is prepared for forming the external resin portion 40 over the outer circumference of the assembled product 1A obtained in the assembling step. The molding assembly includes a container-shaped base having an opening at the top portion, and a lid that closes the opening of the base. Inside the base, the assembled product 1A is accommodated in the upside-down state, i.e., lying on its top face shown in FIG. 1.

The internal bottom face of the base is formed so as to shape the outer shape of the external resin portion 40 shown in FIG. 1, i.e., mainly the shape of the top face side of the reactor 1 out of is outer shape. Specifically, at the internal bottom face of the base, a concave portion is formed. Into this concave portion, the couple portion covering portion 33 of the coil molded product 1M can be fitted. This fitting facilitates the positioning of the assembled product 1A inside the base. Additionally, convex portions for molding the nut accommodating holes 43 shown in FIG. 1 and the slits into which the connection faces 52 of the terminal fittings 50 are inserted are also formed at the internal bottom face of the base.

At the internal bottom face of the base, a total of three resin injection gates aligned on a line are formed. Of the three gates, an inner gate at the intermediate position opens between the paired coil elements 10A and 10B which are paralleled to each other when the assembled product 1A is disposed in the base. The other two outer gates on the opposite sides of the inner gate open at positions such that respective corresponding ones of the exposed core portions 24 are interposed relative to the inner gate. The resin injection gates may be provided at the lid.

On the other hand, the face of the lid facing the base is formed as a flat surface, whereby the installed face of the reactor can be molded into a flat surface. With the face of the lid facing the base being a flat surface, since the lid is free of convex and concave portions which tend to trap the air when resin is injected into the molding assembly having the lid closed, the external resin portion 40 is less likely to suffer from defectiveness. It is to be noted that, provided that no convex and concave portions are formed at the installed face of the reactor 1, the lid can be dispensed with, and just the injection of the resin into the base will suffice. In such a case, the fluid level of the injected resin will form the installed face.

When the assembled product 1A is disposed in the molding assembly, the lid is placed on the opening side of the base. When the molding assembly is closed, unsaturated polyester to be the external resin portion 40 is injected from the resin injection gates into the molding assembly. Here, the cut-out corner portions 24*g* of the exposed core portions 24 each form a groove between the end face of the coil molded product 1M and the exposed core portion 24. Therefore, unsaturated polyester easily enters between the inner end face 24*f* of the exposed core portion 24 and the end face of the coil molded product 1M through the groove. As a result, the resin structuring the external resin portion 40 is fully packed between the coil molded product 1M and the exposed core portion 24, and no voids are formed in the external resin portion 40. Further, since the resin is injected from the inner side and the outer side of the annular core 20 through a plurality of resin injection gates, the pressure acting upon the core from the inner side of the core toward the outer side thereof and the pressure acting upon the core from the outer side of the core toward the inner side thereof cancel out with each other, and hence, the resin can be packed quickly without damaging the core 20. This effect is particularly remarkable when the injection pressure of the resin is high.

When the molding of the external resin portion 40 has finished, the molding assembly is opened and the reactor 1 is taken out from the inside. Thereafter, the nuts 60 are fitted into the nut accommodating holes 43 of the reactor (FIG. 1). Then, the connection faces 52 of the terminal fittings are bent approximately by 90°, such that the connection faces 52 overhang the nuts 60, to complete the reactor 1.

As described above, with the reactor of the present invention, the following effects can be achieved.

Provision of the cut-out corner portion 24*g* at the joining portion of the inner end face 24*f* and each side face 24*s* of the exposed core portions 24 makes it possible to fully pack the resin structuring the external resin portion 40 between the exposed core portions 24 and the end faces of the turn covering portion 31 of the coil molded product 1M through the cut-out corner portion 24*g*. Particularly, as to the reactor 1, in addition to the provision of the cut-out corner portions 24*g*, the interval between the exposed core portion 24 and the end face of the coil molded product 1M is set to 0.5 mm. This also allows the resin structuring the external resin portion 40 to fully be packed. Further, since the reactor 1 has the cut-out corner portions 24*g* of an appropriate size, despite a slight amount of leakage flux, the loss attributed to the leakage flux can be suppressed. Provision of such cut-out corner portions 24*g* achieves productive manufacture of the reactor 1 while achieving miniaturization by narrowing, e.g., the distance between the coil elements 10A and 10B.

When the exposed core portions 24 and the coil molded product 1M are assembled, even in the case where the exposed core portions 24 are handled by a manipulator or the like, each joining portion of the inner end face 24*f* and the side face 24*s* does not become edge-shaped because the cut-out corner portion 24*g* is provided at each virtual ridge line formed by the inner end face 24*f* and an adjacent face (here, each side face 24*s*). Therefore, the occurrence of damage to the exposed core portions 24 can be suppressed. In addition, even in the case where the exposed core portions 24 are brought into contact with the coil 10 when being assembled, the cut-out corner portions 24*g* can suppress the possible occurrence of damage to the insulating coating of the coil 10.

Since the internal resin portion 30 retains the coil 10 so as to be incapable of expanding or compressing, difficulty in handling of the coil that is associated with expansion and compression of the coil can be solved.

Since the internal resin portion 30 functions also to insulate between the coil 10 and the core 20, a sleeve-shaped bobbin or a frame-shaped bobbin used for conventional reactors can be dispensed with.

Since the sensor-use hole 41*h* is molded when the internal resin portion 30 and the external resin portion 40 are molded, it is not necessary to form the sensor-use hole 41*h* in a later process. Therefore, the reactor 1 can be manufactured efficiently while avoiding occurrence of the damage to the coil 10 and the core 20 which may be caused in the case where the sensor-use hole is formed in a later process.

Since the reactor is made up of two resin portions, i.e., two layers of the internal resin portion 30 and the external resin portion 40, the reactor 1 whose coil 10 and core 20 are mechanically and electrically protected can easily be formed. Particularly, since the internal resin portion 30 is formed of resin exhibiting high heat dissipating performance and the external resin portion 40 is formed of resin exhibiting high shock resistance, the reactor exhibiting both the heat dissipating performance and the mechanical strength can be obtained. Particularly, provision of the external resin portion 40 implements the reactor 1 possessing high mechanical strength despite its core being structured with a pressurized powder compact of soft magnetic powder.

Since the through holes 42*h* for fixing the reactor 1 to the cooling base are formed by molding at the flange portions 42 of the external resin portion 40, the reactor 1 can be installed by simply inserting bolts into the through holes 42*h* to screw into the cooling base, without the necessity of separately preparing any hardware for fastening the reactor other than the bolts. Particularly, use of the metal collars 42*c* for the through holes reinforces the through holes 42*h*, and suppresses occurrence of cracks at the flange portions 42 which may otherwise be caused by tightening the bolts.

Since paired exposed core portions 24 are different from each other in height; the terminal fittings 50 are disposed on the exposed core portion 24 whose height is low; and the exposed core portions 24 and the coil molded product 1M are integrally molded with the external resin portion 40, an increase in height of the reactor 1 including the terminal fittings 50 will not occur.

Since the terminal fittings 50 are integrally formed by molding of the external resin portion 40, the terminal block can be structured simultaneously with the molding of the external resin portion 40. Therefore, any members or works for fixing a separately produced terminal block to the reactor 1 can be dispensed with.

Since the couple portion 10*r* of the coil is raised higher than the turn-formed face 10*f*, an increase in the height of the exposed core portions 24 can be achieved while a reduction in the thickness (the length in the coil axial direction) can be achieved. Thus, the projected area of the reactor 1 can be reduced. Particularly, by structuring the core 20 with a pressurized powder compact of soft magnetic powder, the core 20 in which the exposed core portions 24 and the internal core portions 22 are different from each other in height can easily be molded. Further, since the bottom faces 24*d* of the exposed core portions 24 are flush with the bottom face of the coil molded product 1M and the bottom face of the external resin portion 40, the installed face of the reactor 1 can be formed as a flat surface, and a wide contact area with the fixation target can be secured. Further, efficient heat dissipation can be achieved.

Since not the nuts 60 themselves but the nut accommodating holes 43 are formed by molding of the external resin portion 40, there are no nuts 60 at the time of molding the external resin portion 40. Thus, the resin structuring the external resin portion 40 is prevented from entering inside the nuts. On the other hand, since the connection faces 52 of the terminal fittings 50 are bent to overhang the openings of the nut accommodating holes 43 after the nuts 60 are accommodated in the nut accommodating hole 43, the nuts 60 can easily be prevented from coming off (Variation 1)

In Embodiment 1, the coil molded product 1M in which the internal core portions 22 are integrated with the coil 10 by the internal resin portion 30 is used. However, the internal resin portion may be formed such that a hollow space is formed in each of the coil elements 10A and 10B. Such molding can be carried out by inserting inner molds inside the coil 10 in place of the internal core portions 22, and injecting the resin structuring the internal resin portion in a state where the coil 10 having inserted therein the inner molds are accommodated in the molding assembly.

(Variation 2)

In Embodiment 1, the description has been given of the structure including the cut-out corner portion 24*g* at each joining portion of the inner end face 24*f* and the side face 24*s* of each exposed core portion 24. However, for example, as can be seen in an exposed core portion 24α shown in FIG. 6 (I), in addition to the joining portion of the inner end face 24*f* and the side face 24*s*, the cut-out corner portion 24*g* may be provided over the entire area of the virtual ridge line of the inner end face 24*f* and the top and bottom faces (the top face 24*u*), that is, over the entire area of the virtual circumference of the inner end face 24*f* Such a cut-out corner portion 24*g* can easily be molded by employing a pressurized powder compact as the core. In addition, the cut-out corner portion 24*g* can be formed by works such as cutting, an abrasive operation and the like, as described above. In this mode, the cut-out corner portion 24*g* provides a clearance over the entire area of the inner end face 24*f* between the coil end face and the inner end face 24*f* of the exposed core portion 24α. This further makes it easier for the resin structuring the external resin portion to be introduced between the coil and the core. Further, since the exposed core portion 24α has a line-symmetric shape, any one of the top and bottom faces shown in FIG. 6 (I) can be used as the installed face, and hence, it exhibits excellent assemblability. Further, since the exposed core portion 24α has the cut-out corner portion 24*g* at the entire circumference of the virtual circumference, it can address an increase or a reduction in the end face dimension of the coil to some extent. Therefore, it is expected to be versatile.

Figure 6:
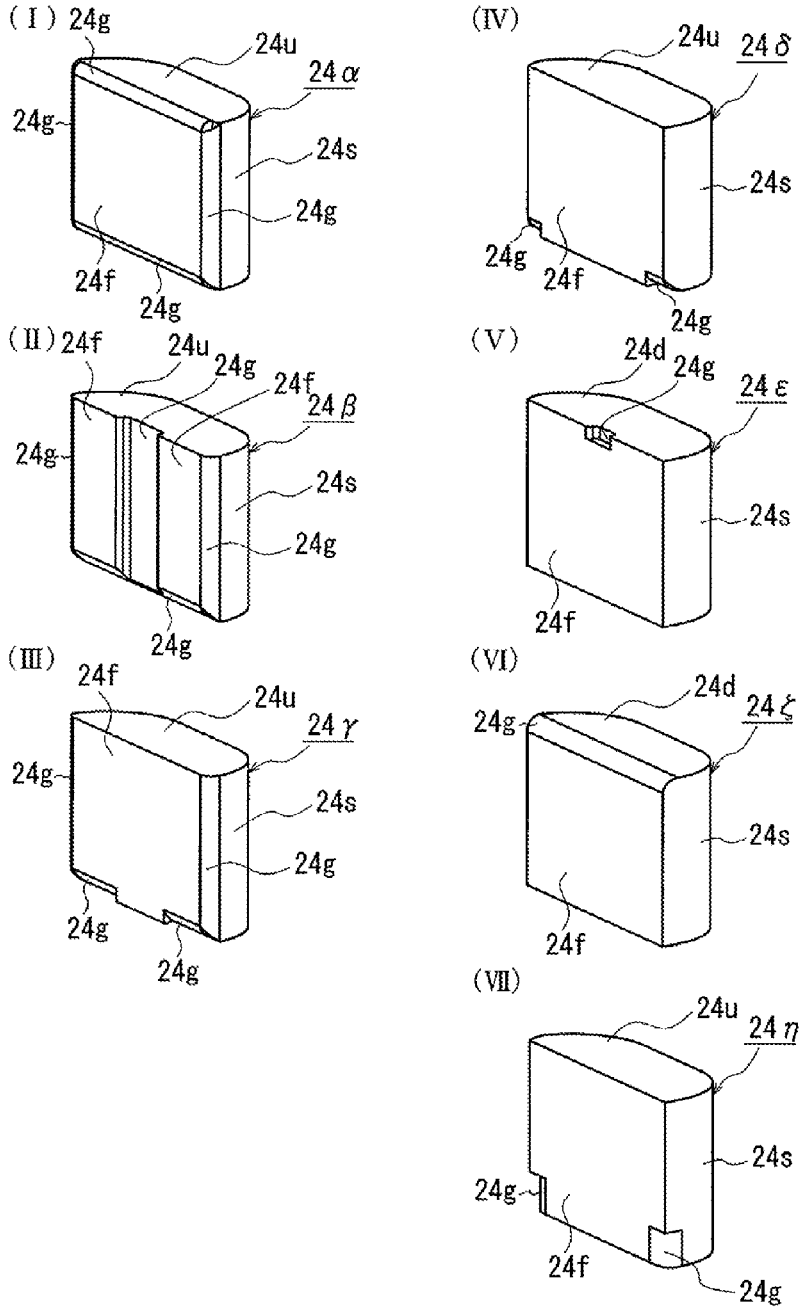

Alternatively, as can be seen in an exposed core portion 24β shown in FIG. 6 (II), a mode can be employed in which, in addition to each joining portion of the inner end face 24*f* and the side face 24*s*, the cut-out corner portion 24*g* is provided over the entire area of the virtual ridge line formed by the inner end face 24*f* and the one of the top and bottom faces (here, the bottom face opposite to the top face 24*u*); or, in which the cut-out corner portion 24*g* is provided to the portion in the inner end face 24*f* where wires of the paired coil element are paralleled next to each other when the reactor is assembled. In short, the cut-out corner portion 24*g* may be provided to the central portion of the inner end face 24*f*. In the example shown in FIG. 6 (II), the cut-out corner portion 24*g* whose cross-section is rectangular is provided to the entire area in the top-bottom direction of the inner end face 24*f*, such that [-shaped (square-bracket shaped) groove is provided. However, it is to be noted that the length of the groove can appropriately be changed (see FIG. 6 (V)).

Alternatively, as can be seen in an exposed core portion 24γ shown in FIG. 6 (III), a mode can be employed in which, in addition to each joining portion of the inner end face 24*f* and the side face 24*s*, the cut-out corner portion 24*g* is provided to only part of the joining portion of the inner end face 24*f* and one of the top and bottom faces (here, the bottom face opposite to the top face 24*u*). In the exposed core portion 24γ, the joining portion of the inner end face 24*f* and the bottom face is structured by the cut-out corner portions 24*g* and the ridge line formed by the inner end face 24*f* and the bottom face. Such cut-out corner portions 24*g* can easily be molded by employing a pressurized powder compact as the core.

As shown in Embodiment 1 and FIGS. 6 (I) to 6 (III), in addition to the modes in which the cut-out corner portions 24*g* are provided to a plurality of virtual ridge lines out of four virtual ridge lines of the inner end face 24*f*, a mode in which the cut-out corner portion 24*g* is provided to only one virtual ridge line of the inner end face 24*f* can be employed. For example, as can be seen in an exposed core portion 24δ shown in FIG. 6 (IV), what can be employed is a mode in which the cut-out corner portion 24*g* is provided to only a part of the virtual ridge line formed by the inner end face 24*f* and one of the top and bottom faces (here, the bottom face opposite to the top face 24*u*). Particularly, the exposed core portion 24δ is in a mode in which the cut-out corner portions 24*g* are respectively provided to the regions near the side faces 24*s*. Alternatively, as can be seen in an exposed core portion 24ϵ shown in FIG. 6 (V), what can be employed is a mode in which the cut-out corner portion 24*g* is provided to only a part of the virtual ridge line (here, the central portion facing the portion where wires of the coil elements are paralleled to be next to each other) formed by the inner end face 24*f* and one of the top and bottom faces (here, the bottom face 24*d*); or what can be employed is a mode in which, as can be seen in an exposed core portion 24ζ shown in FIG. 6 (VI), the cut-out corner portion 24*g* is provided over the entire area of the virtual ridge line formed by the inner end face 24*f* and one of the top and bottom faces (here, the bottom face 24*d*). It is to be noted that, only FIGS. 6 (V) and 6 (VI) show the exposed core portion in the upside-down state, in which the bottom face 24*d* is faced up.

Alternatively, in addition to those modes in which the cut-out corner portions 24*g* are provided over the entire area of a plurality of virtual ridge lines as shown in Embodiment 1 and FIGS. 6 (I) to 6 (III), as can be seen in the exposed core portion 24η shown in FIG. 6 (VII), what can be employed is a mode in which the cut-out corner portion 24*g* is provided to only a part of each of a plurality of virtual ridge lines. The exposed core portion 24η is in the mode in which the cut-out corner portions 24*g* are provided to only the regions at one of the top and bottom faces (here, the bottom face opposite to the top face 24*u*) near the virtual ridge lines formed by the inner end face 24*f* and the side faces 24*s*, respectively. In addition, what can be employed is a mode in which the cut-out corner portion 24*g* is provided to a part of the virtual ridge line formed by the inner end face 24*f* and at least one of the side faces 24*s* and to a part of the virtual ridge line formed by the inner end face 24*f* and at least one of the top and bottom faces. Further, though the exposed core portion 24η has the cut-out corner portions 24*g* being identical to each other in shape, size, and formation place, the cut-out corner portion 24*g* may be different from each other in shape, size, and formation place.

In the modes shown in FIGS. 6 (II) to 6 (VII), provision of the cut-out corner portion 24*g* to at least a part of at least one virtual ridge line out of four virtual ridge lines of the inner end face 24*f* allows the cut-out corner portion 24*g* to be disposed on the side where the resin is introduced upon the external resin portion being formed, for example. This makes it easier to allow the resin to be introduced between the coil and the core. Particularly, in the modes shown in FIGS. 6 (II) and (III), provision of the cut-out corner portions 24*g* at a plurality of virtual ridge lines out of four virtual ridge lines of the inner end face 24*f* and provision of the cut-out corner portion 24*g* over the entire area of at least one virtual ridge line allows the resin to be packed in an excellent manner.

Figure 7:
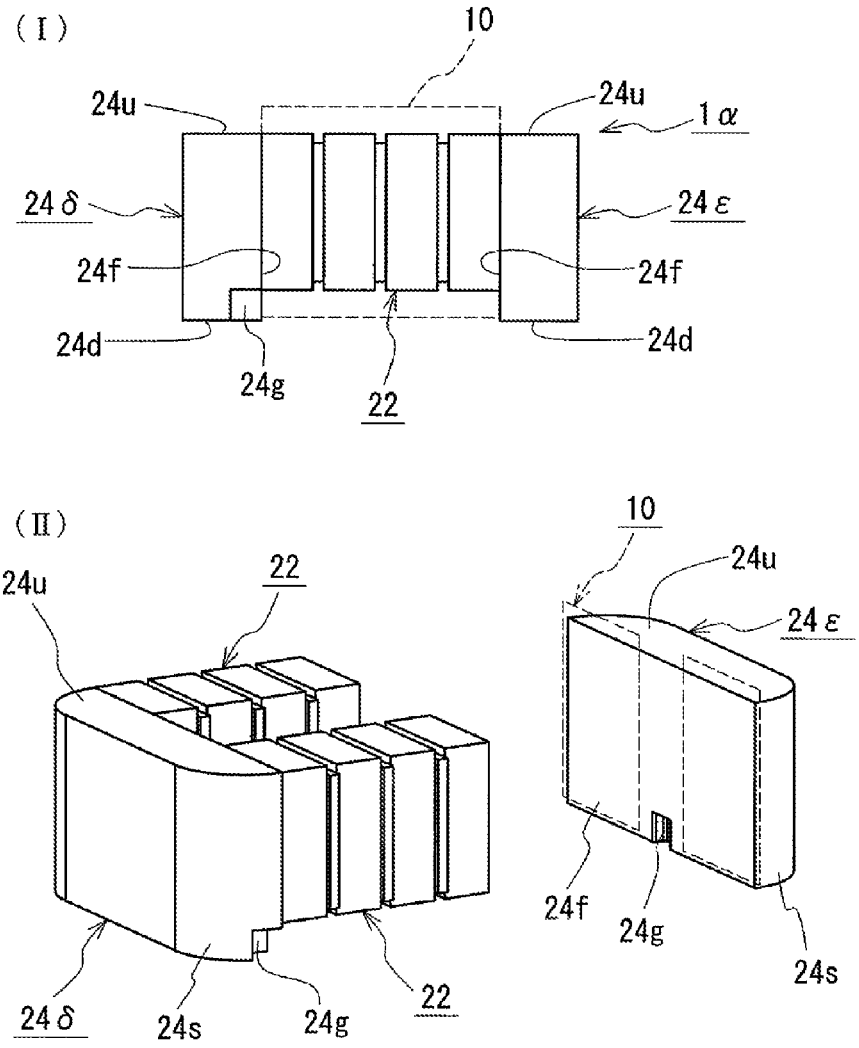
FIG. 7 shows a variation of an assembled product made up of the core and the coil included in the reactor according to Embodiment 1 of the present invention, in which FIG. 7 (I) is a schematic front view and FIG. 7 (II) is an exploded perspective view of the core.

Further, in the modes shown in FIG. 6, particularly, the modes in which the cut-out corner portion 24*g* is provided to at least a part of the joining portion of the inner end face 24*f* and the face to be the installed side (here, the bottom face 24*d*) are expected to contribute to improving the packing performance of the resin relative to the mode in which, as the reactor 1α shown in FIG. 7, the face to be the installation side of each exposed core portion, i.e., the bottom face 24*d*, projects outward than the face to be installation side of the internal core portions 22. In the mode in which the exposed core portions extend toward the installation side (i.e., the mode where the top faces 24*u* of the exposed core portions and the top faces of the internal core portions 22 are flush with each other in FIG. 7), as shown in FIG. 7, the clearance between the end face of the coil 10 and the inner end face 24*f* of the exposed core portion tends to be narrow. Further, in the case where the external resin portion is formed in a state where the installed faces of the exposed core portions are brought into contact with the molding assembly of the external resin portion or the case whose description will follow, it becomes difficult to secure enough space between the assembled product made up of the coil and the core and the molding assembly or the case, and hence it becomes difficult for the resin to be packed. In contrast, as can be seen in the exposed core portions 24α to 24η, particularly, provision of the cut-out corner portion 24*g* to the joining portion of the face to be the installed side and the inner end face 24*f* can improve the packing performance of the resin structuring the external resin portion. In the case as can be seen in the exposed core portions 24 δ, 24ϵ, and 24η shown in FIGS. 6 (IV), 6 (V), and 6 (VII) in which the cut-out corner portions 24*g* are provided only near the portions where the end face of the coil is in close proximity to the joining portion of the inner end face 24*f* of the exposed core portion and the adjacent faces also, an improvement in the packing performance of the resin can be expected.

It is to be noted that, in FIG. 7, though one exposed core portion is the exposed core portions 24δ shown in FIG. 6 (IV), and the other exposed core portion is the exposed core portions 24ϵ shown in FIG. 6 (V), it is merely an illustration. Normally, the exposed core portions being identical to each other in shape are used. Further, the joining portions of the cut-out corner portion 24*g* and the inner end face 24*f*, the side faces 24*s*, the top face 24*u*, and the bottom face 24*d* shown in FIG. 6 may each be in an edge-like shape. However, when they are curved (rounded) as shown in FIG. 6, the core can preferably be prevented from being chipped off and the coil can be prevented from being damaged. Further, the cut-out corner portions 24*g* shown in FIGS. 6 (IV) to 6 (VI) may be provided only to the joining portion of the inner end face 24*f* and the top face 24*u*, or may be provided both of the joining portion of the inner end face 24*f* and the top face 24*u* and the joining portion of the inner end face 24*f* and the bottom face 24*d*.

(Embodiment 2)

Figure 8:
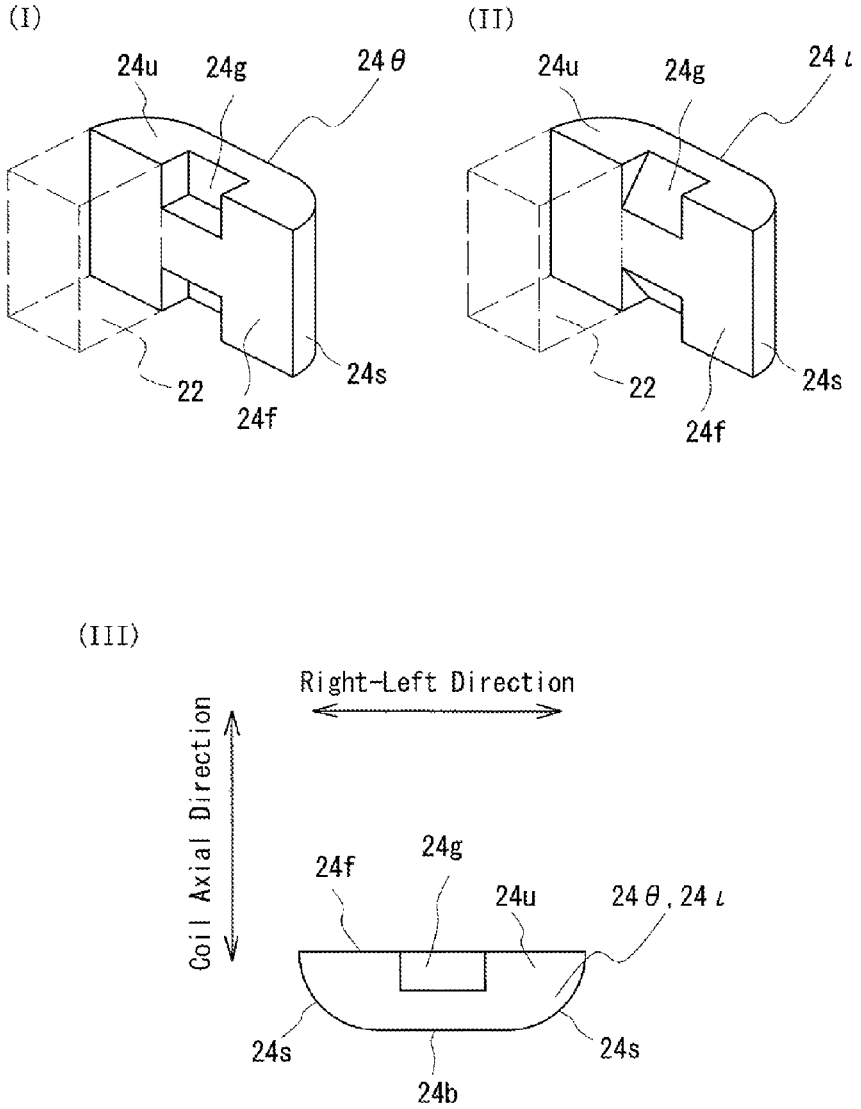

Next, with reference to FIG. 8, a description will be given of a reactor according to Embodiment 2 having cut-out corner portions being different from those according to Embodiment 1. The main difference of the present embodiment from the Embodiment 1 lies in the mode of the exposed core portions and absence of the internal resin portion. The rest of the structure is substantially the same as Embodiment 1. Therefore, the following description will be given mainly of the difference. It is to be noted that, in FIG. 8, the exposed core portion is shown by solid lines, and only one of the internal core portions 22 is shown by broken lines, while the other one is omitted. Further, for the convenience of the description, the cut-out corner portion 24*g* are exaggerated and drawn greater than the actual scale.

While the exposed core portions 24θ and 24ι both have the substantially trapeziform cross-sectional shape similarly to Embodiment 1, they are identical to the internal core portions 22 in height, and the top and bottom faces (the top face 24*u*) of the exposed core portions 24θ and 24ι are structured to be flush with the top and bottom faces of the internal core portions 22. That is, the core shown in Embodiment 2 is a flat core. Further, when the internal core portions 22 and the exposed core portions 24θ or the exposed core portions 24ι are combined to be an annular core, the outer circumference face of the core is continuous through the internal core portions 22 and the exposed core portions 24θ or the exposed core portions 24θ, and the side faces 24*s* of the exposed core portions 24θ and the side faces 24*s* of each exposed core portion 24ι will not extend outward than the side faces of the internal core portions 22. That is, in the case where the coil elements are disposed on the outer side of the internal core portions 22, respectively, of the inner end faces 24*f* of the exposed core portions 24θ and 24ι, the portion facing the end face of the coil is only the region facing the portion where the wires of the coil elements are disposed in parallel to be next to each other (here, only the central portion).

In the exposed core portions 24θ and 24ι structured as described above, the cut-out corner portion 24*g* is provided at each joining portion of the inner end face 24*f* and the top and bottom faces (top face 24*u*) of the exposed core portions. Specifically, as shown in FIG. 8 (I), a cut-out portion whose cross section is rectangular is provided at the intermediate portion in the right-left direction (the horizontal direction perpendicular to the coil axial direction) of the exposed core portion 24θ, to obtain the cut-out corner portion 24*g*. The formation portion of the cut-out corner portion 24*g* is the portion that faces the end face of the coil when the coil is disposed on the outer side of the internal core portions 22, and where the wires of the coil elements are paralleled to be next to each other. Alternatively, as can be seen in the exposed core portion 24*t* shown in FIG. 8 (II), a cut-out portion whose cross section is triangular may be provided to the identical portion as in the exposed core portion 24θ, to obtain the cut-out corner portion 24*g* of other structure. With the exposed core portions 24θ and 24ι shown in FIG. 8, the joining portions of the inner end face 24*f* and the top and bottom faces (the top face 24*u*) are structured by ridge lines formed by the cut-out corner portion 24*g* and the inner end face 24*f* and by the top and bottom faces (the top face 24*u*).

For structuring the reactor with such cores, first, the coil is disposed on the outer side of the internal core portions 22. Next, the exposed core portions 24θ or the exposed core portions 24ι are joined to the opposite end faces of the internal core portions 22. Then, the outer circumference of the assembled product of the core and the coil is covered by the external resin portion.

According to the present embodiment also, the resin structuring the external resin portion can be guided from the cut-out corner portion to the space between the coil elements at the end faces of the coil. Therefore, as compared to a case where no cut-out corner portions are present, the external resin portion can more surely be packed between the coil and the core. It is to be noted that, in the present embodiment also, the internal resin portion may be included.

(Embodiment 3)

Next, with reference to FIG. 9, a description will be given of an embodiment of the present invention in which a case is used. The difference of a reactor 1β according to Embodiment 3 from other embodiments lies in that a case 70 is used and the internal resin portion is not used. Similarly to Embodiment 1, the exposed core portions 24 are provided with the cut-out corner portions. In the following, a description will be given mainly of the difference.

The case 70 included in the reactor 1β is rectangular and has a bottomed container-shape, whose top portion is open. The case 70 is made of a metal material that is excellent in heat conductivity, such as aluminum alloy. In the case 70, the assembled product of the core 20 and the coil 10 is stored. In the assembled product according to the present embodiment, the coil 10 that does not use the internal resin portion is combined with the core 20, and a bobbin 80 is used instead of the internal resin portion. The bobbin 80 is structured with a sleeve-like bobbin (not shown) interposed between the coil 10 and the internal core portion and a frame-shaped bobbin 80F interposed between the exposed core portions 24 and the coil end faces. As being combined with the sleeve-shaped bobbin, the frame-shaped bobbin 80F secures insulation between the core 20 and the coil 10, and also contributes to defining the length in the axial direction of the coil 10.

Then, by accommodating the assembled product inside the case 70, and packing the potting resin to be the external resin portion 40 between the case and the assembled product, the reactor 1β is formed. As the resin, epoxy resin, polyurethane resin or the like can preferably be used. The potting resin seals the constituents of the assembled product inside the case 70 other than the ends of the wire 10*w* of the coil 10.

With the structure of the present embodiment, when the potting resin is packed inside the case 70, provision of the cut-out corner portion at each joining portion of the inner end face and the side face of the exposed core portions 24 makes it possible to secure the interval between the internal face of the case 70 and each of the cut-out corner portions, and to improve the resin flow of the potting resin around the cut-out corner portions. Further, by the cut-out corner portions, the resin flow between the frame-shaped bobbin 80F and the exposed core portions 24 can be improved. Thus, the packing time of the potting resin is reduced. Further, the potting resin is fully packed around the assembled product, and occurrence of voids inside the resin can be suppressed. It goes without saying that the coil 10 and the core 20 are mechanically and electrically protected by the case 70 and the potting resin.

(Variation 3)

In the embodiment described above, the description has been given of the structure in which the cut-out corner portions are provided to the exposed core portions of the core. However, it is possible to employ a mode in which the cut-out corner portions are provided to the exposed core portions, and additionally similar cut-out portions are provided to various reactor components that are disposed so as to be brought into contact with the coil and the magnetic core. That is, one mode of the present invention may be a mode including a reactor component that is disposed so as to be brought into contact with at least part of the coil and the core. The reactor component is at least partially covered by the external resin portion that covers the assembled product made up of the coil and the core. The reactor component includes a cut-out portion in at least part of the joining portion of a contact face that contacts at least one of the coil and the core and an adjacent face that is continuous to the contact face.

The reactor component may be of various modes, such as a heat dissipation member for improving the heat dissipating performance of the reactor, a fix member for fixing the magnetic core, a support member that supports the core and the coil, the aforementioned bobbin, and the gap members included in the core. More specifically, the reactor component may be any element such as the gap member that is integrated with the core by a joining material such as an adhesive agent or an adhesion tape, any element that is fixed to or integrated with the core and the case by a fixing tool such as a bolt, any element such as a bobbin or the aforementioned support member that is fixed to the coil, the core and the case by the resin structuring the external resin portion, or any element that is integrally molded with the case. The material structuring the reactor component may include various materials, such as metal (irrespective of magnetic or non-magnetic), ceramics, heat resistant resin and the like.

In the case where the reactor component is disposed so as to be brought into contact with the core and the coil, it is difficult to allow the resin to be packed not only the space between the core and the coil, but also the space between the core or the coil and the reactor component. Addressing such a problem, by providing the cut-out portions similarly to the cut-out corner portions of the exposed core portions to the reactor component as described above, it becomes easier for the resin to be packed between the core or the coil and the reactor component, and the packing performance of the resin can further be improved.

(Convertor, Power Conversion Device)

The reactor according to any of the first to third embodiments and modifications may be used for a component of a converter mounted on a vehicle or the like, or a component of a power conversion device including the converter.

Figure 9:
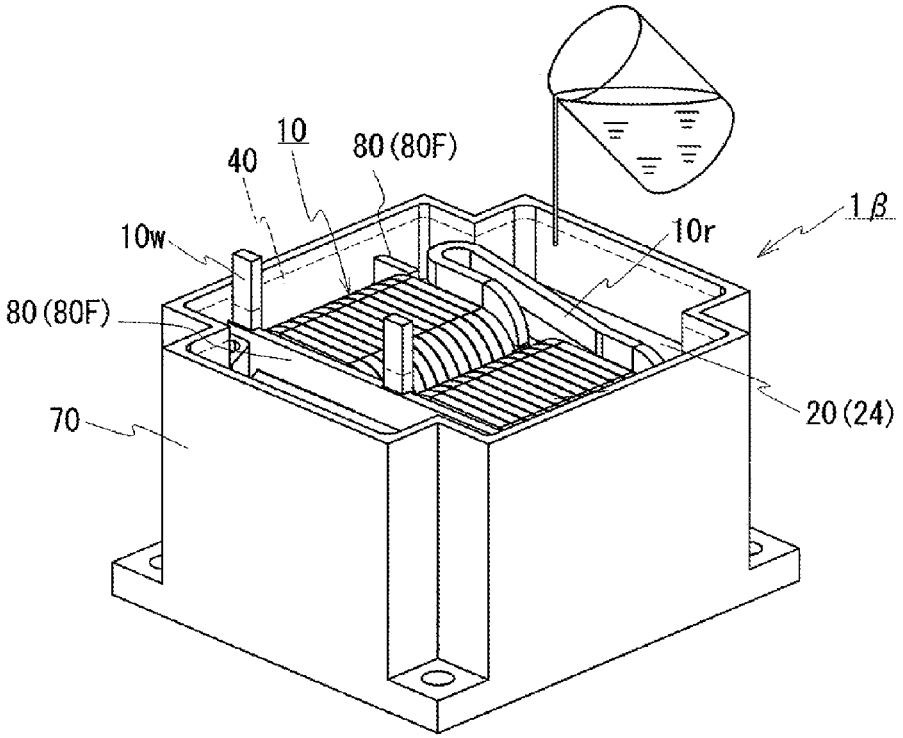
FIG. 9 is a schematic perspective view showing a reactor of the present invention according to Embodiment 3.
Figure 10:
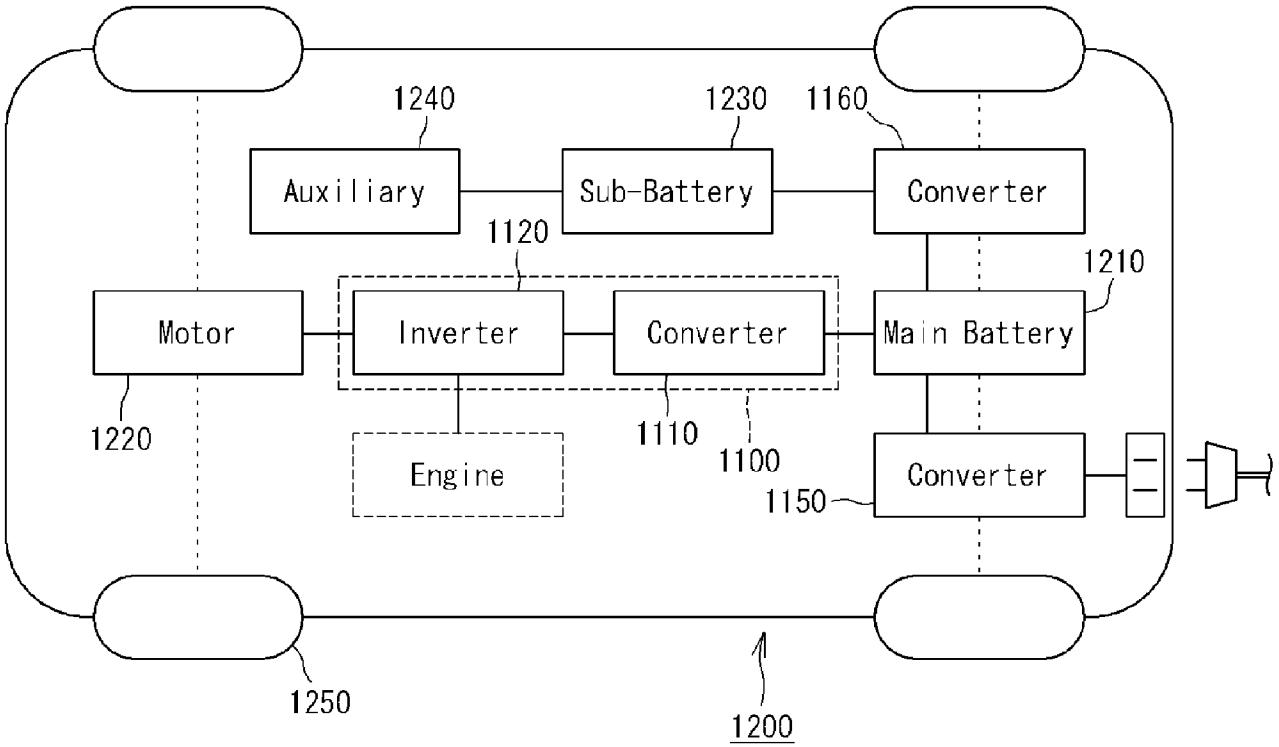
FIG. 10 is a brief configuration diagram schematically showing a power supply system of a hybrid electric vehicle.
Figure 11:
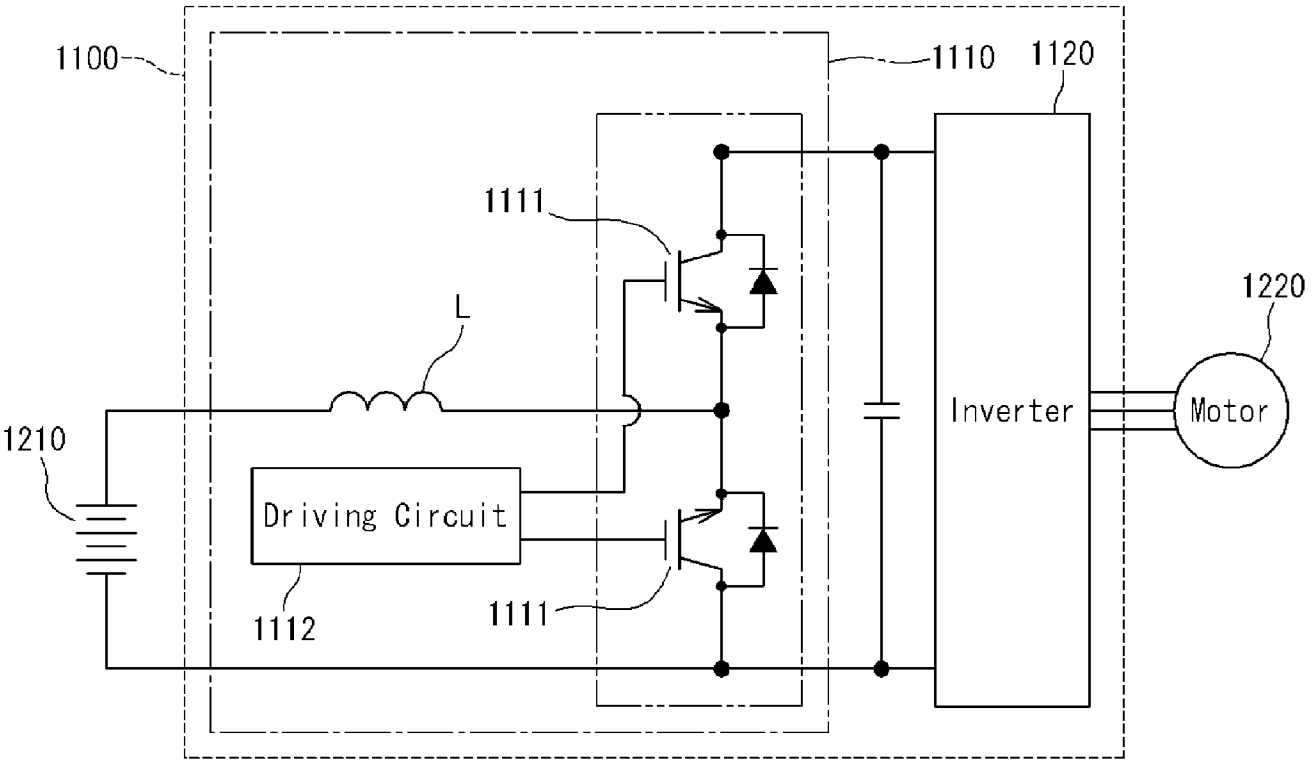
FIG. 11 is a brief circuit diagram showing an example of a power conversion device including a converter.

For example, as shown in FIG. 9, a vehicle 1200, which is a hybrid electric vehicle or an electric vehicle, includes a main battery 1210, a power conversion device 1100 connected to the main battery 1210, and a motor (a load) 1220 driven by a power fed from the main battery 1210 and used for traveling. The motor 1220 is typically a three-phase alternating current motor. The motor 1220 drives wheels 1250 during traveling and functions as a generator during regeneration. In case of a hybrid electric vehicle, the vehicle 1200 includes an engine in addition to the motor 1220. FIG. 8 illustrates an inlet as a charging portion of the vehicle 1200; however, a plug may be included.

The power conversion device 1100 includes a converter 1110 connected to the main battery 1210, and an inverter 1120 that is connected to the converter 1110 and performs conversion between direct current and alternating current. During traveling of the vehicle 1200, the converter 1110 steps up a direct-current voltage (input voltage) of the main battery 1210, which is in a range from 200 to 300 V, to a level in a range from about 400 to 700 V, and then feeds the power to the inverter 1120. Also, during regeneration, the converter 1110 steps down the direct-current voltage (the input voltage) from the motor 1220 through the inverter 1120 to a direct-current voltage suitable for the main battery 1210, and then uses the direct-current voltage for the charge of the main battery 1210. During traveling of the vehicle 1200, the inverter 1120 converts the direct current stepped up by the converter 1110 into predetermined alternating current and feeds the alternating current to the motor 1220. During regeneration, the inverter 1120 converts the alternating current output from the motor 1220 into direct current and outputs the direct current to the converter 1110.

As shown in FIG. 9, the converter 1110 includes a plurality of switching elements 1111, a driving circuit 1112 that controls operations of the switching elements 1111, and a reactor L. The converter 1110 converts the input voltage (in this situation, performs step up and down) by repetition of on and off operations (switching operations). The switching elements 1111 each use a power device, such as field effect transistor (FET) or an insulated-gate bipolar transistor (IGBT). The reactor L uses a characteristic of a coil that disturbs a change of current which flows through the circuit, and hence has a function of making the change smooth when the current is increased or decreased by the switching operation. The reactor L is the reactor according to any of the embodiments and modifications. By using the reactor that has a effect which the external resin portion 40 can be made from the resin fully packed, it is possible to improve fault-tolerance and productivity of the power conversion device 1100 (including the converter 1110).

The vehicle 1200 includes, in addition to the converter 1110, a feeding device converter 1150 connected to the main battery 1210, and an auxiliary power supply converter 1160 that is connected to a sub-battery 1230 serving as a power source of an auxiliary 1240 and the main battery 1210 and that converts a high voltage of the main battery 1210 to a low voltage. The converter 1110 typically performs DC-DC conversion, whereas the feeding device converter 1150 and the auxiliary power supply converter 1160 perform AC-DC conversion. The feeding device converter 1150 may include a kind that performs DC-DC conversion. The feeding device converter 1150 and the auxiliary power supply converter 1160 each may include a configuration similar to the reactor according to any of the above-described embodiments and modifications, and the size and shape of the reactor may be properly changed. Also, the reactor according to any of the above-described embodiments and modifications may be used for a converter that performs conversion for the input power and that performs only stepping up or stepping down.

It is to be noted that, the embodiments described above can be modified as appropriate without departing from the gist of the present invention, and are not limited to the structures described above.

Industrial Applicability

The reactor of the present invention can be used as a component of a converter or the like. Particularly, it can be used as a vehicular reactor, such as of a hybrid vehicle or of an electric vehicle.

REFERENCE SIGNS LIST

1, 1α, 1β: REACTOR
1M: COIL MOLDED PRODUCT
1A: ASSEMBLED PRODUCT
10: COIL
10A, 10B: COIL ELEMENT
10*w*: WIRE
10*e*: END (WIRE END)

10*t*: TURN PORTION
10*f*: TURN-FORMED FACE
10*r*: COUPLE PORTION
20: CORE
22: INTERNAL CORE PORTION
22*c*: CORE PIECE
22*g*: GAP MEMBER
24, 24α, 24β, 24γ, 24δ, 24ε, 24ζ, 24η, 24θ, 24ι: EXPOSED CORE PORTION
24*f*: INNER END FACE
24*s*: SIDE FACE
24*b*: OUTER END FACE
24*u*: TOP FACE
24*d*: BOTTOM FACE
24*g*: CUT-OUT CORNER PORTION
30: INTERNAL RESIN PORTION
31: TURN COVERING PORTION
33: COUPLE PORTION COVERING PORTION
40: EXTERNAL RESIN PORTION
41*h*: SENSOR-USE HOLE
42: FLANGE PORTION
42*h*: THROUGH HOLE
42*c*: METAL COLLAR
43: NUT ACCOMMODATING HOLE
50: TERMINAL FITTING
52: CONNECTION FACE
52*h*: INSERTION HOLE
60: NUT
70: CASE
80: BOBBIN
80F: FRAME-SHAPED BOBBIN
1000: REACTOR
100: COIL
200: CORE
220: INTERNAL CORE PORTION
240: EXPOSED CORE PORTION
220*g*: GAP MEMBER
1100: POWER CONVERSION DEVICE
1110: CONVERTER
1111: SWITCHING ELEMENT
1112: DRIVING CIRCUIT
L: REACTOR
1120: INVERTER
1150: FEEDING DEVICE CONVERTER
1160: AUXILIARY POWER SUPPLY CONVERTER
1200: VEHICLE
1210: MAIN BATTERY
1220: MOTOR
1230: SUB-BATTERY
1240: AUXILIARY
1250: WHEEL

The invention claimed is:

1. A reactor, comprising:

a coil formed with paired coil elements that are made of a spirally wound wire, the coil elements being coupled to each other in a paralleled state;

internal core portions that are fitted into the paired coil elements to structure a part of an annular core;

exposed core portions that are exposed outside the coil elements to couple the internal core portions to each other, to thereby form a rest of the annular core; and an external resin portion that covers at least a part of an assembled product made up of the coil and the core, wherein a resin structuring the external resin portion is packed between an inner end face of the exposed core portion and an end face of the coil; and an interval formed by the resin structuring the external resin portion between the inner end face of the exposed core portion and the end face of the coil is 0.5 mm to 4.0 mm.

2. The reactor according to claim 1, further comprising a coil molded product, the product includes the coil, and internal resin portion that retains a shape of the coil, and the internal core portion that integrated with the coil by the internal resin portion, wherein the interval between the inner end face of the exposed core position and the end face of the coil is an interval between the inner end face of the exposed core portion and the end face of the coil molded product.

3. The reactor according to claim 1, further comprising a case that accommodates the assembled product.

4. A convertor including the reactor according to claim 1.

5. A power conversion device including the converter according to claim 4.

* * * * *